US010273787B2

(12) United States Patent
Montaron et al.

(10) Patent No.: US 10,273,787 B2
(45) Date of Patent: Apr. 30, 2019

(54) CREATING RADIAL SLOTS IN A WELLBORE

(71) Applicant: SCHLUMBERGER TECHNOLOGY CORPORATION, Sugar Land, TX (US)

(72) Inventors: Bernard Andre Montaron, Kuala Lumpur (MY); Troy Fields, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 220 days.

(21) Appl. No.: 15/103,064

(22) PCT Filed: Dec. 12, 2014

(86) PCT No.: PCT/US2014/070121
§ 371 (c)(1),
(2) Date: Jun. 9, 2016

(87) PCT Pub. No.: WO2015/089458
PCT Pub. Date: Jun. 18, 2015

(65) Prior Publication Data

US 2016/0312587 A1 Oct. 27, 2016

Related U.S. Application Data

(60) Provisional application No. 61/915,746, filed on Dec. 13, 2013.

(51) Int. Cl.
*E21B 29/06* (2006.01)
*E21B 43/11* (2006.01)
(Continued)

(52) U.S. Cl.
CPC ..... *E21B 43/11* (2013.01); *E21B 17/1078* (2013.01); *E21B 23/01* (2013.01);
(Continued)

(58) Field of Classification Search
CPC . E21B 43/114; E21B 43/2405; E21B 43/2401
See application file for complete search history.

(56) References Cited

U.S. PATENT DOCUMENTS 3,461,964 A 8/1969 Venghiattis
3,749,878 A 7/1973 Sullivan et al.
(Continued)

FOREIGN PATENT DOCUMENTS

CA 2596201 A1 2/2010
EP 0644316 A2 3/1995
(Continued)

OTHER PUBLICATIONS

International Search Report and Written Opinion issued in PCT/US2014/070121 dated Mar. 25, 2015; 10 pages.
(Continued)

*Primary Examiner* — Brad Harcourt
*Assistant Examiner* — David Carroll
(74) *Attorney, Agent, or Firm* — Michael L. Flynn; Robin Nava

(57) ABSTRACT

A laser cutting apparatus operable in a wellbore to form radial slots in a subterranean formation penetrated by the wellbore and a casing lining at least a portion of the wellbore. The laser cutting apparatus includes a housing, a deflector system, and an optical member. The deflector system is disposed for rotation about a first axis within the housing and is rotatable about a second axis at a distance from the first axis. The optical member conducts a laser beam incident upon the deflector system.

18 Claims, 12 Drawing Sheets

(51) Int. Cl.

| | |
|---|---|
| ***E21B 17/10*** | (2006.01) |
| ***E21B 23/01*** | (2006.01) |
| ***E21B 37/00*** | (2006.01) |
| ***E21B 43/26*** | (2006.01) |
| ***E21B 47/09*** | (2012.01) |
| *E21B 47/12* | (2012.01) |
| *E21B 49/00* | (2006.01) |

(52) U.S. Cl.
CPC ..... *E21B 29/06* (2013.01); *E21B 37/00* (2013.01); *E21B 43/26* (2013.01); *E21B 47/0905* (2013.01); *E21B 47/12* (2013.01); *E21B 49/00* (2013.01)

(56) References Cited

U.S. PATENT DOCUMENTS

| | | | | |
|---|---|---|---|---|
| 4,199,034 | A | 4/1980 | Salisbury et al. | |
| 4,850,431 | A | 7/1989 | Austin et al. | |
| 4,974,675 | A | 12/1990 | Austin et al. | |
| 4,977,961 | A | 12/1990 | Avasthi | |
| 5,249,628 | A | 10/1993 | Surjaatmadja | |
| 5,325,923 | A | 7/1994 | Surjaatmadja et al. | |
| 5,335,724 | A | 8/1994 | Venditto et al. | |
| 5,361,856 | A | 11/1994 | Surjaatmadja et al. | |
| 5,381,631 | A | 1/1995 | Raghavan et al. | |
| 5,396,957 | A | 3/1995 | Surjaatmadja et al. | |
| 5,445,220 | A | 8/1995 | Gurevich et al. | |
| 5,482,116 | A | 1/1996 | El-Rabaa et al. | |
| 5,494,103 | A | 2/1996 | Surjaatmadja et al. | |
| 5,820,795 | A | 10/1998 | Takemori et al. | |
| 6,286,599 | B1 | 9/2001 | Surjaatmadja et al. | |
| 6,351,991 | B1 | 3/2002 | Sina | |
| 6,394,184 | B2 | 5/2002 | Tolman et al. | |
| 6,543,538 | B2 | 4/2003 | Tolman et al. | |
| 6,564,868 | B1 | 5/2003 | Ferguson et al. | |
| 6,904,365 | B2 | 6/2005 | Bratton et al. | |
| 6,975,465 | B1 | 12/2005 | Chung et al. | |
| 7,032,671 | B2 | 4/2006 | Aud | |
| 7,096,954 | B2 | 8/2006 | Weng et al. | |
| 7,357,182 | B2 | 4/2008 | Hunt et al. | |
| 7,413,010 | B2 | 8/2008 | Blauch et al. | |
| 7,434,633 | B2 | 10/2008 | Lynde et al. | |
| 7,527,092 | B2 | 5/2009 | McAfee | |
| 7,546,876 | B2 | 6/2009 | McAfee | |
| 7,571,766 | B2 | 8/2009 | Pauls et al. | |
| 7,640,982 | B2 | 1/2010 | Schlutz et al. | |
| 7,644,761 | B1 | 1/2010 | Gu et al. | |
| 7,788,037 | B2 | 8/2010 | Soliman et al. | |
| 7,828,063 | B2 | 11/2010 | Olsen et al. | |
| 7,848,895 | B2 | 12/2010 | Zoback et al. | |
| 7,882,745 | B2 | 2/2011 | Huang et al. | |
| 8,126,646 | B2 | 2/2012 | Grove et al. | |
| 8,126,689 | B2 | 2/2012 | Soliman et al. | |
| 8,439,116 | B2 | 5/2013 | East, Jr. et al. | |
| 8,770,316 | B2 | 7/2014 | Jelsma | |
| 8,887,803 | B2 | 11/2014 | East, Jr. et al. | |
| 9,297,250 | B2 | 3/2016 | Dusterhoft et al. | |
| 2004/0206505 | A1 | 10/2004 | Batarseh | |
| 2004/0206733 | A1 | 10/2004 | Hillebrand et al. | |
| 2005/0173388 | A1 | 8/2005 | Lavers et al. | |
| 2006/0102343 | A1 | 5/2006 | Skinner et al. | |
| 2006/0231257 | A1 | 10/2006 | Reed et al. | |
| 2008/0166132 | A1 | 7/2008 | Lynde et al. | |
| 2009/0045176 | A1* | 2/2009 | Wawers | G02B 27/40 219/121.67 |
| 2009/0065252 | A1 | 3/2009 | Moos et al. | |
| 2009/0109794 | A1 | 4/2009 | Sinha | |
| 2009/0125240 | A1 | 5/2009 | Den Boer et al. | |
| 2009/0133871 | A1* | 5/2009 | Skinner | E21B 7/15 166/250.16 |
| 2009/0288833 | A1 | 11/2009 | Graham et al. | |
| 2009/0288834 | A1 | 11/2009 | Jelsma | |
| 2009/0288884 | A1 | 11/2009 | Jelsma | |
| 2010/0250214 | A1 | 9/2010 | Prioul et al. | |
| 2010/0326659 | A1 | 12/2010 | Schultz et al. | |
| 2011/0017458 | A1 | 1/2011 | East, Jr. et al. | |
| 2011/0198087 | A1 | 8/2011 | Adam | |
| 2011/0209868 | A1 | 9/2011 | Dusterhoft et al. | |
| 2011/0247815 | A1 | 10/2011 | Jelsma | |
| 2012/0176862 | A1 | 7/2012 | DAngelo et al. | |
| 2012/0217019 | A1 | 8/2012 | Zediker et al. | |
| 2013/0008659 | A1* | 1/2013 | Schultz | E21B 29/02 166/297 |
| 2013/0032349 | A1 | 2/2013 | Alekseenko et al. | |
| 2013/0220604 | A1 | 8/2013 | El-Rabaa et al. | |
| 2013/0228372 | A1 | 9/2013 | Linyaev et al. | |
| 2013/0228557 | A1 | 9/2013 | Zediker et al. | |
| 2014/0069653 | A1 | 3/2014 | Liu et al. | |
| 2014/0182933 | A1 | 7/2014 | Skinner et al. | |
| 2014/0222405 | A1 | 8/2014 | Lecerf et al. | |
| 2014/0278316 | A1 | 9/2014 | Dusterhoft et al. | |
| 2015/0129211 | A1 | 5/2015 | Dusseault et al. | |
| 2015/0176400 | A1 | 6/2015 | Kulathu et al. | |
| 2016/0108705 | A1 | 4/2016 | Maxwell et al. | |
| 2016/0273325 | A1 | 9/2016 | Montaron | |
| 2017/0214213 | A1 | 7/2017 | Zediker et al. | |

FOREIGN PATENT DOCUMENTS

| | | | |
|---|---|---|---|
| WO | 2001061146 | A1 | 8/2001 |
| WO | 2002006629 | A1 | 1/2002 |
| WO | 2004009956 | | 1/2004 |
| WO | 2009096805 | | 8/2009 |
| WO | 2011148315 | A2 | 12/2011 |
| WO | 2012031009 | A1 | 3/2012 |
| WO | 2014036742 | A1 | 3/2014 |
| WO | 2014078663 | A2 | 5/2014 |

OTHER PUBLICATIONS

Jet Edge, "Waterjet Success Stories Case Studies," [online], [retrieved on Jan. 4, 2012], Retrieved from the Internet<URL: http://jetedge.com/content.cfm?fuseaction=dsp_success_case&case_ID=92>.

Halao, C., "A Study of Horizontal Wellbore Failure," SPE16927, SPE Production Engineering, Nov. 1988, pp. 489-494.

Yew et al., "Fracturing of a Deviated Well," SPE 16930, SPE Production Engineering, Nov. 1988, pp. 429-437.

Rabaa, W. El, "Experimental Study of Hydraulic Fracture Geometry Initiated From Horizontal Wells," SPE 19720, presented at the 64th Annual Technical Conference and Exhibition of the Society of Petroleum Engineers, San Antonio, Texas, Oct. 8-11, 1989, pp. 189-204.

Hossain et al., "A Comprehensive Monograph for Hydraulic Fracture Initiation From Deviated Wellbores Under Arbitrary Stress Regimes," SPE 54360, presented at the 1999 SPE Asia Pacific Oil and Gas Conference and Exhibition, Jakarta, Indonesia, Apr. 20-22, 1999, pp. 1-11.

Waters, et al., "Use of Horizontal Well Image Tools to Optimize Barnett Shale Reservoir Exploitation," SPE 103202, presented at the 2006 SPE Annual Technical Conference and Exhibition, San Antonio, Texas, Sep. 24-27, 2006, pp. 1-13.

Thiercelin et al., "Formation Characterization: Rock Mechanics", Economides M.J. and Nolte K.G., Reservoir Stimulation, John Wiley and Sons, Ltd, 3rd Edition New York, 2000, Chapter 3, pp. 3-1 to 3-35.

Smith et al., "Basics of Hydraulic Fracturing", Economides M.J. and Nolte K.G., Reservoir Stimulation, John Wiley and Sons, Ltd, 3rd Edition New York, 2000-Chapter 5, pp. 5-1 to 5-28.

Gulbis et al., "Fracturing Fluid Chemistry and Proppants", Economides M.J. and Nolte K.G., Reservoir Stimulation, John Wiley and Sons, Ltd, 3rd Edition New York, 2000-Chapter 7, pp. 7-1 to 7-23.

Aadnoy, "Stresses Around Horizontal Boreholes Drilled in Sedimentary Rocks," Journal of Petroleum Science and Engineering, 2 (1989), pp. 349-360.

International Search Report and Written Opinion issued for International Patent Application No. PCT/CN2012/081211 dated Jun. 13, 2013, 11 pages.

(56) References Cited

OTHER PUBLICATIONS

Almaguer et al., "Orienting Perforation in the Right Direction", Oilfield Review, Spring 2002, pp. 16-31.
Extended European Search Report issued in European Patent Appl. No. 15854773.7 dated Jul. 5, 2018; 5 pages.

* cited by examiner

CREATING RADIAL SLOTS IN A WELLBORE

CROSS-REFERENCE TO RELATED APPLICATIONS

This application is a 35 U.S.C. § 371 National Phase of International Patent Application No. PCT/US2014/070121, filed Dec. 12, 2014, which claims the benefit of U.S. Provisional Application No. 61/915,746, entitled "APPARATUS AND METHOD TO CREATE RADIAL SLOTS IN A WELLBORE," filed Dec. 13, 2013, both applications of which the entire disclosures are hereby incorporated herein by reference.

BACKGROUND OF THE DISCLOSURE

Oilfield operations may be performed to locate and gather downhole fluids, such as those containing hydrocarbons. Wellbores may be drilled along a desired trajectory to reach one or more subterranean rock formations containing the hydrocarbons and other downhole fluids. The trajectory may be defined to facilitate passage through the subterranean rock formation(s) and to facilitate production. The selected trajectory may have vertical, angled, and/or horizontal portions. The trajectory may be selected based on vertical and/or horizontal stresses of the formation, boundaries of the formation, and/or other characteristics of the formation.

Natural fracture networks extending through the formation also provide pathways for the flow of fluid. For example, fracturing operations may include creating and/or expanding fractures in the formation to create and/or increase flow paths within the formation, such as by injecting treatment fluids into the formation via a wellbore penetrating the formation. Fracturing may be affected by various factors relating to the wellbore, such as the presence of casing and cement in a wellbore, open-hole completions, and the intended spacing for fracturing and/or injection, among other examples.

Fracturing operations may also include perforating operations, such as may be performed in a cased wellbore to make it possible for reservoir fluids to flow past the casing into the cased wellbore. Perforations may be formed using various techniques to cut through casing, cement, and/or the formation.

In vertical wellbores, and under a wide range of rock stress states such as may include the abnormal stress conditions referred to as strike-slip faults, hydraulic fractures may initiate and propagate in a vertical plane that extends longitudinally relative to the wellbore (i.e., along a plane that contains the wellbore axis). Vertical hydraulic fractures created in hydrocarbon-bearing sedimentary formations may have substantially higher hydrocarbon productivity than horizontal fractures. This is due to the anisotropic permeability of sedimentary formations, such as where the horizontal permeability is substantially greater than the vertical permeability.

The environment for creating fractures is more complex in horizontal wellbores. In a normal stress state (i.e., where vertical stress components due to overburden pressure is substantially greater than horizontal stress components), the hydraulic fractures created from a horizontal wellbore via perforations extending normal to the wellbore initiate in a vertical plane that extends longitudinally relative to the wellbore. As hydraulic fracturing fluid is pumped into the wellbore, the fractures propagate along the same plane, but at distances further away from the wellbore, the direction of the fractures changes to follow a vertical plane that is parallel to the direction of the maximum horizontal stress components. Such change of direction results in complex fluid pathways extending from the hydraulic fractures to the wellbore, resulting in a bottleneck that reduces the overall hydraulic conductivity of the fractures, and adversely impacting hydrocarbon productivity.

In a horizontal wellbore extending into a formation under abnormal stress state, such as a strike-slip fault state where vertical stresses are between the maximum and minimum horizontal stress components, the fractures also initiate in a plane extending longitudinally relative to the wellbore if normal perforations are used. However, under strike-slip conditions, the initiation plane is horizontal and the fractures may continue to develop in a horizontal direction. This can be detrimental to hydrocarbon production because horizontal fractures produce substantially less than vertical fractures of the same surface area in the same formation.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a laser cutting apparatus operable in a wellbore to form radial slots in a subterranean formation penetrated by the wellbore and a casing lining at least a portion of the wellbore. The laser cutting apparatus includes a housing, a deflector system disposed for rotation about a first axis and rotatable about a second axis at a distance from the first axis, and an optical member conducting a laser beam incident upon the deflector system.

The present disclosure also introduces a system that includes a laser cutting system operable in a wellbore to remove material from a subterranean formation penetrated by the wellbore and a casing lining the wellbore. The laser cutting system includes a laser source located at a wellsite surface from which the wellbore extends, an optical conductor in optical communication with the laser source, and a tool string comprising a laser cutting apparatus. The laser cutting apparatus includes a deflection system operable to direct a laser beam received from the laser source via the optical conductor to be incident upon the casing and the formation. At least a portion of the deflection system is operable to rotate about first and second radially offset axes.

The present disclosure also introduces a method that includes conveying a tool string to a target location within a wellbore. The tool string includes a laser cutting apparatus. The method also includes operating the laser cutting apparatus to form casing slots extending through a casing lining the wellbore, and formation slots extending into a subterranean formation penetrated by the wellbore. Each of the casing slots and each of the formation slots extend substantially within a plane that is substantially perpendicular to a longitudinal axis of the wellbore. The casing slots each circumferentially extend through corresponding first angles about the longitudinal axis of the wellbore. The formation slots each circumferentially extend through corresponding second angles about the longitudinal axis of the wellbore. Each of the second angles is greater than each of the first angles.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
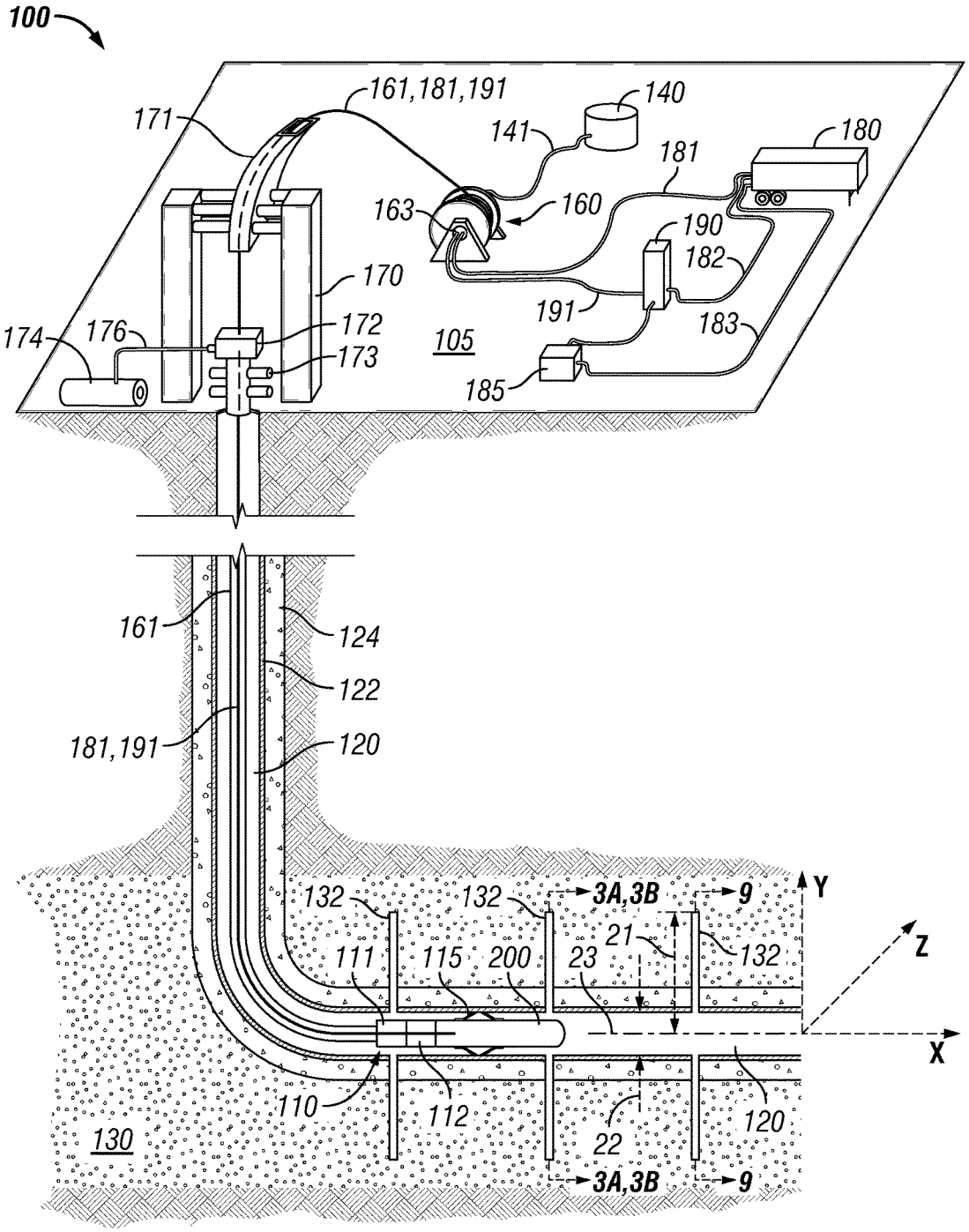
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of a laser cutting system 100 according to one or more aspects of the present disclosure. For example, FIG. 1 depicts a wellsite surface 105 adjacent a wellbore 120, a sectional view of the earth below the wellsite surface 105, and the example laser cutting system 100. The example laser cutting system 100 is operable to form radial slots and/or perforations 132 in a wellbore casing 122 and a subterranean rock formation 130 penetrated by the wellbore 120. In the context of the present disclosure, the term "subterranean rock formation" (or simply "formation") may be given its broadest possible meaning and may include, without limitation, various rocks and other natural materials, as well as cement and other artificial materials, including rock layer formations, such as, granite, basalt, sandstone, dolomite, sand, salt, limestone, rhyolite, quartzite, and shale, among others. The wellbore 120 may extend from the wellsite surface 105 into one or more formations 130. When utilized in cased-hole implementations, a cement sheath 124 may secure the casing 122 within the wellbore 120.

At the wellsite surface 105, the laser cutting system 100 may comprise a control center/source of electrical power 180, which may provide control signals and electrical power via electrical conductors 181, 182, 183 extending between the control center/source of electrical power 180 and a laser source 190, a laser generator chiller 185, and a tool string 110 positioned within the wellbore 120. The laser source 190 may provide energy in the form of a laser beam to a laser cutting apparatus 200 forming at least a portion of the tool string 110. An optical conductor 191, such as may comprise one or more fiber optic cables, may convey the laser beam from the laser source 190 to the laser cutting apparatus 200.

The laser cutting system 100 may further comprise a fluid source 140 from which fluid may be conveyed by a fluid conduit 141 to a spool 160 of coiled tubing 161 and/or other conduits that may be deployed into the wellbore 120. The spool 160 may be rotated to advance and retract the coiled tubing 161 within the wellbore 120. The optical conductor 191, the electrical conductor 181, and the fluid conduit 141 may be attached to the coiled tubing 161 by, for example, a swivel or other rotating coupling 163. The coiled tubing 161 may be operable to convey the fluid received from the fluid source 140 along the length of the wellbore 120 to the tool string 110 coupled at the downhole end of the coiled tubing 161. The coiled tubing 161 may be further operable to transmit or convey therein the optical conductor 191 and/or the electrical conductor 181 from the wellsite surface 105 to the tool string 110. The electrical and optical conductors 181, 191 may be disposed within the coiled tubing 161 inside a protective metal carrier (not shown) to insulate and protect the conductors 181, 191 from the fluid inside the coiled tubing 161. Alternatively, the optical conductor 191 and/or the electrical conductor 181 may be conveyed into the wellbore 120 on the outside of the coiled tubing 161.

The laser cutting system 100 may further comprise a support structure 170, such as may include a coiled tubing injector 171 and/or other apparatus operable to facilitate movement of the coiled tubing 161 in the wellbore 120. Other support structures may be also included, such as a derrick, a crane, a mast, a tripod, and/or other structures. A diverter 172, a blow-out preventer (BOP) 173, and/or a fluid handling system 174 may also be included as part of the laser cutting system 100. For example, during deployment, the coiled tubing 161 may be passed from the injector 171, through the diverter 172 and the BOP 173, and into the wellbore 120.

The tool string 110 may be conveyed along the wellbore 120 via the coiled tubing 161 in conjunction with the coiled tubing injector 171, such as may be operable to apply an adjustable uphole and downhole force to the coiled tubing 161 to advance and retract the tool string 110 within the wellbore 120. Although FIG. 1 depicts a coiled tubing injector 171, it should be understood that other means operable to advance and retract the tool string 110, such as a crane, winch, drawworks, top drive, and/or other lifting device coupled to the tool string 110 via the coiled tubing 161 and/or other conveyance means (e.g., wireline, drill pipe, production tubing, etc.), may be included as part of the laser cutting system 100.

During operations, fluid may be conveyed through the coiled tubing 161 and may exit into the wellbore 120 adjacent to the tool string 110. For example, the fluid may be directed into an annular area between the sidewall of the wellbore 120 and the tool string 110 through one or more ports in the coiled tubing 161 and/or the tool string 110 (such as the ports 214 shown in FIG. 2A). Thereafter, the fluid may flow in the uphole direction and out of the wellbore 120. The diverter 172 may direct the returning fluid to the fluid handling system 174 through one or more conduits 176. The fluid handling system 174 may be operable to clean the fluid and/or prevent the fluid from escaping into the environment. The fluid may then be returned to the fluid source 140 or otherwise contained for later use, treatment, and/or disposal.

The downhole end of the coiled tubing 161 may comprise a first portion 111, a second portion 112 coupled with the first portion 111, and the laser cutting apparatus 200 coupled with the second portion 112. The tool string 110 is further shown in connection with the optical conductor 191 and the electrical conductor 181, which may extend through at least a portion of the first and second portions 111, 112 of the tool string 110 and the laser cutting apparatus 200. As stated above, the optical conductor 191 may be operable to transmit the laser beam from the laser source 190 to the laser cutting apparatus 200, whereas the electrical conductor 181 may be operable to transmit electrical control signals and/or electrical power between the control center/source of electrical power 180 and the first and second portions 111, 112 of the tool string 110 and/or the laser cutting apparatus 200.

The electrical conductor 181 may also permit electrical communication between the first and second portions 111, 112 of the tool string 110 and the laser cutting apparatus 200, and may comprise various electrical connectors and/or interfaces (not shown) for electrical connection with the first and second portions 111, 112 of the tool string and the laser cutting apparatus 200. Although the electrical conductor 181 is depicted in FIG. 1 as a single continuous electrical conductor, the laser cutting system 100 may comprise a plurality of electrical conductors (not shown) extending along the coiled tubing 161, wherein one or more of the conductors may be separately connected with the first portion 111, the second portion 112, and/or the laser cutting apparatus 200. Also, although FIG. 1 depicts the laser cutting apparatus 200 being coupled at the downhole end of the tool string 110, the laser cutting apparatus 200 may be coupled between the first and second portions 111, 112 of the tool string 110, or further uphole in the tool string 110 with respect to the first and the second portions 111, 112. The tool string 110 may also comprise more than one instance of the laser cutting apparatus 200, as well as other apparatus not explicitly described herein.

The first and second portions 111, 112 of the tool string 110 may each be or comprise at least a portion of one or more downhole tools, modules, and/or other apparatus operable in wireline, while-drilling, coiled tubing, completion, production, and/or other operations. For example, the first and second portions 111, 112 may each be or comprise at least a portion of an acoustic tool, a density tool, a directional drilling tool, a drilling tool, an electromagnetic (EM) tool, a formation evaluation tool, a gravity tool, a formation logging tool, a magnetic resonance tool, a formation measurement tool, a monitoring tool, a neutron tool, a nuclear tool, a photoelectric factor tool, a porosity tool, a reservoir characterization tool, a resistivity tool, a seismic tool, a surveying tool, a telemetry tool, and/or a tough logging condition tool. However, other downhole tools are also within the scope of the present disclosure. Although FIG. 1 depicts the tool string 110 comprising two portions 111, 112 directly and/or indirectly coupled with the laser cutting apparatus 200, it should be understood that the tool string 110 may comprise a different number of portions each directly and/or indirectly coupled with the laser cutting apparatus 200.

The first portion 111 may be or comprise a logging tool, such as a casing collar locator (CCL) operable to detect ends of casing collars by sensing a magnetic irregularity caused by the relatively high mass of an end of a collar of the casing 122. The CCL may transmit a signal in real-time to wellsite surface equipment, such as the control center/source of electrical power 180, via the electrical conductor 181. The CCL signal may be utilized to determine the position of the laser cutting apparatus 200 with respect to known casing collar numbers and/or positions within the wellbore 120. Therefore, the CCL may be utilized to detect and/or log the location of the laser cutting apparatus 200 within the wellbore 120. Although the first portion 111 comprising the CCL is depicted as separate tool indirectly coupled with the laser cutting apparatus 200, it should be understood that the CCL or other locator tool may be integrated into the laser cutting apparatus 200.

The second portion 112 of the tool string 110 may comprise an inclination sensor and/or other orientation sensors, such as one or more accelerometers, magnetometers, gyroscopic sensors (e.g., micro-electro-mechanical system (MEMS) gyros), and/or other sensors for utilization in determining the orientation of the tool string 110 relative to the wellbore 120. Although the second portion 112 comprising the orientation sensor is depicted as a separate tool coupled with the laser cutting apparatus 200, it should be understood that the orientation sensor(s) may be integrated into the laser cutting apparatus 200.

An anchoring device 115 may also be included as part of the tool string 110, such as may be operable to positionally fix or set the laser cutting apparatus 200 relative to the wellbore 120 (e.g., against the casing 122) at an intended location for cutting a radial slot 132 in the casing 122 and/or formation 130. For example, the anchoring device 115 may positively fix or set the laser cutting system 200 along the central axis 23 of the wellbore 120, such that the central axis 215 (e.g., see FIG. 2A) of the laser cutting apparatus 200 may substantially coincide with the central axis 23 of the wellbore 120. Centralizing of the laser cutting apparatus 200 along the wellbore 120 may further centralize the first axis of rotation 251 of a deflection system 250 (e.g., see FIG. 2A), such that the central axis 23 of the wellbore 120 and the first axis of rotation 251 substantially coincide. The anchoring device 115 may be controlled mechanically, hydraulically, electrically, and/or otherwise, such as to retract the anchoring device 115 before moving the coiled tubing 161 to another location. The anchoring device 115 may be selected from various fixation or setting devices, such as an anchor or a packer, which may be operable to centralize, anchor, and/or fix the tool string 110 and/or the laser cutting apparatus 200 at a predetermined stand-off distance and/or position along the wellbore 120. The anchoring device 115 may also or instead comprise embedding or friction elements, such as bumpers or slips, which may engage the inner surface of the casing 120. Although FIG. 1 depicts the anchoring device 115 as part of the laser cutting apparatus 200, it should be understood that the anchoring device 115 may be included in the tool string 110 as a separate tool or portion, such as part of the first and/or second portions 111, 112 of the tool string 110.

FIG. 1 further depicts coordinates axes X, Y, and Z, which may be utilized as references to aid in identifying relative positions of certain aspects of the tool string 110 or components thereof within three-dimensional space. The X-axis extends along the longitudinal axis 23 of the wellbore 120, and may substantially coincide with a longitudinal axis of the laser cutting apparatus 200 during operation of the laser cutting apparatus 200. The Y-axis extends vertically with respect to the earth and perpendicularly with respect to the X-axis, and the Z-axis extends perpendicularly with respect to the X- and Y-axes.

The laser cutting apparatus 200 is operable to create radial slots 132 or other perforations in the formation 130. The radial slots 132 may be utilized to initiate one or more hydraulic fractures along a plane that is transverse to the longitudinal axis of the wellbore 120, such as along the plane defined by the Y- and Z-axes, hereafter referred to as the Y-Z plane (e.g., see FIGS. 7 and 8). The radial slots 132 may penetrate deep enough into the formation 130 around the wellbore 120 so as to permit the hydraulic fracture(s) to propagate along the Y-Z plane as initiated. An intended depth or the penetration distance of the radial slots 132, referred hereinafter as the radial distance 21, may be equal to about twice the diameter 22 of the wellbore 120, although other depths are also within the scope of the present disclosure.

The radial slots 132 may be utilized for hydraulic fracturing in horizontal wells. For example, hydrocarbon productivity may be enhanced by forming a plurality of radial slots 132 through the formation 130 along a plane substantially transverse (i.e., perpendicular) to the wellbore axis 23, such as the Y-Z plane. Each radial slot 132 may extend circumferentially along an angle around the wellbore 120 to form angular sectors. Utilizing conveyance or deployment means, such as coiled tubing 161, may further provide the ability to generate a plurality of radial slots 132 along the length of the wellbore 120 for a multi-stage fracturing treatment within a single coiled tubing trip. However, the radial slots 132 may also be operable in applications other than hydraulic fracture initiation, including applications in which shallower radial slots 132 or perforations may be utilized.

Certain special geometry radial slots (such as radial slots 132*a-d* shown in FIGS. 15 and 16) may be substantially oriented along the direction of gravity. Such orientation may be achieved via utilization of an inclination sensor and/or other orientation sensor, such as described above with respect to the second portion 112 of the tool string 110, which may be utilized to measure the direction of gravity relative to the laser cutting apparatus 200. The orientation sensor may also or instead be incorporated into a tool controller (such as the tool controller 220 shown in FIG. 2A), which may be operable to communicate signals from the orientation sensor to the wellsite surface 105 via the electrical conductor 181, although the signals may also or instead be processed by the controller 220. Accordingly, the orientation of the laser cutting apparatus 200 (and/or a deflection system 250 of the laser cutting apparatus 200, as described below) may be adjusted to form the radial slots 132 in a plane that is substantially coincident with the direction of gravity.

The controller 220 of the laser cutting apparatus 200 may be operable to control the laser cutting apparatus to form the radial slots 132 having a predetermined configuration, such as may define the intended angles of the radial slots 132, depths of the radial slots 132, and/or spacing between adjacent radial slots 132. For example, the controller 220 may be programmed at the wellsite surface 105 prior to conveying the laser cutting apparatus 200 down the wellbore 120. The controller 220 may be programmed with information relating to geometries and other parameters of the radial slots 132 to facilitate formation of such radial slots 132. The parameters may include the number and orientation of the radial slots 132 with respect to the central axis 23 of the wellbore 120 and/or direction of gravity. The laser cutting apparatus 200 may be programmed such that each radial slot 132 or set of radial slots 132 may comprise a unique (e.g., different) predefined configuration. Therefore, the controller and/or the programming may facilitate a substantially automatic radial slot 132 formation process, perhaps with no or minimal communication with the control center/source of electrical power 180 at the wellsite surface 105.

The radial slots 132 created by the laser cutting apparatus 200 may comprise a continuous or substantially continuous 360-degree slot (e.g., see FIG. 13) that extends through the casing 122 and the cement sheath 124 and into the formation 130 surrounding the wellbore 120, along the plane substantially transverse (i.e., substantially perpendicular) to the wellbore axis 23, such as the Y-Z plane. The radial slots 132 may also comprise a set of discontinuous (i.e., discrete) radial slots (e.g., see FIGS. 9 and 11) that extend through the casing 122 and the cement sheath 124 and into the formation 130 surrounding the wellbore 120, along the plane substantially transverse to the wellbore axis 23, such as the Y-Z plane. Although not extending a full 360-degrees, such discontinuous pattern of radial slots 132 may be utilized to initiate or assist in initiating a transverse fracture with respect to the wellbore axis 23, provided a sufficient number and size of slots 132 and/or perforations are created along the plane substantially transverse to the wellbore axis 23. The discontinuous pattern of the radial slots 132 may be operable to maintain the mechanical integrity of the casing 122 by avoiding a full severing of the casing 122 around its circumference, such that the casing 122 may be cut less than 360-degrees around its circumference even though the radial slots 132 extend through 360 degrees within the formation 130.

Figure 2A:
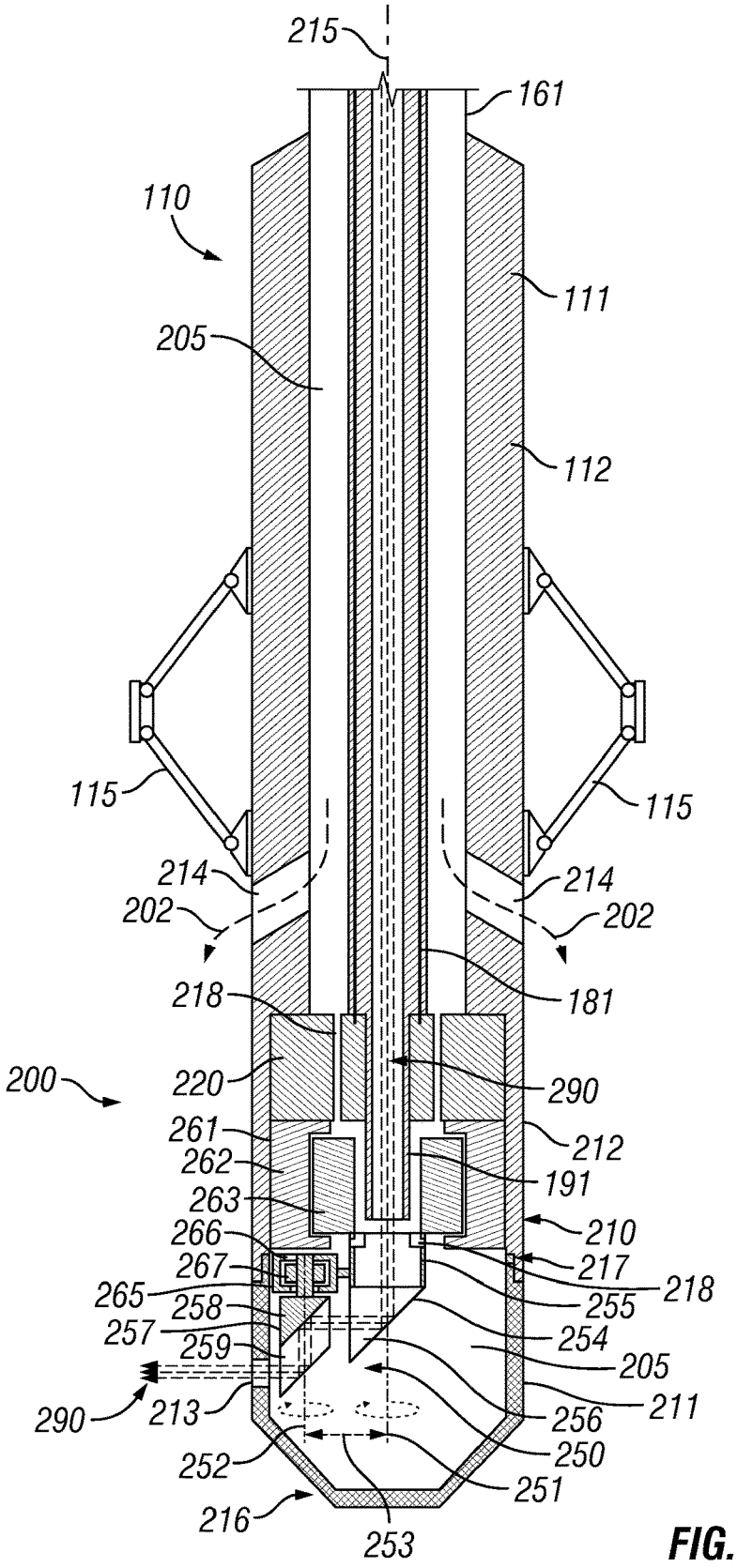
FIG. 2A is a sectional view of a portion of an example implementation of the apparatus shown in FIG. 1 according to one or more aspects of the present disclosure.
Figure 2B:
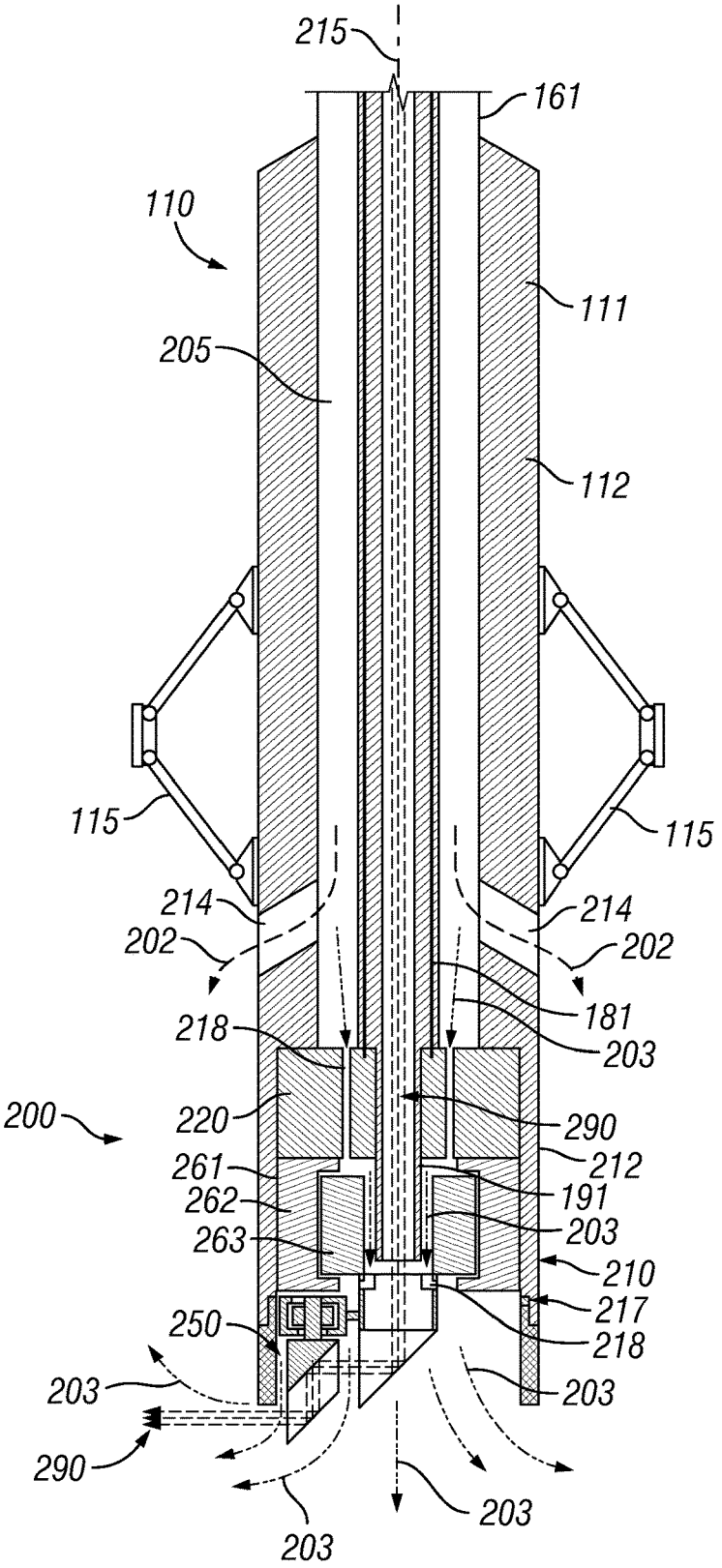
FIG. 2B is a sectional view of a portion of an example implementation of the apparatus shown in FIG. 2A according to one or more aspects of the present disclosure.

FIGS. 2A and 2B are sectional views of a portion of the example implementation of the laser cutting system 100 shown in FIG. 1 according to one or more aspects of the present disclosure. FIGS. 2A and 2B depict the tool string 110 having the first portion 111 coupled to the coiled tubing 161, the second portion 112 coupled to the first portion 111, and the laser cutting apparatus 200 coupled to the second portion 112. Although FIGS. 2A and 2B depict the tool string 110 comprising the first and second portions 111, 112, it should be understood that the first and second portions 111, 112 may be omitted from the tool string 110, such as in implementations in which the coiled tubing 161 and the laser cutting apparatus 200 may be coupled directly with each other.

Referring collectively to FIGS. 1, 2A, and 2B, the laser cutting apparatus 200 comprises a housing 110 having an internal space 205 extending along at least a portion thereof. The housing 110 may comprise a first housing section 211 and a second housing section 212. The first housing section 211, also referred to herein as a protection cover, may be rotationally coupled with the second housing section 212 in a manner permitting the first housing section 211 to rotate relative to the second housing section 212, such as about a first axis 251. The first axis 251 may substantially coincide with a central, longitudinal axis 215 of the laser cutting apparatus 200, the first housing section 211, and/or the second housing section 212.

The first housing section 211 may be disposed at the downhole end of the laser cutting apparatus 200, and may comprise a bowl-shaped or other configuration having an open end 217 and a closed end 216. The open end 217 of the first housing section 211 may be rotatably engaged or otherwise coupled with the second housing section 212, such as to permit the above-described rotation of the first housing section 211 relative to the second housing section 212.

The first housing section 211 may enclose internal components of the laser cutting apparatus 200 and/or prevent wellbore fluid from communicating into the interior of the laser cutting apparatus 200. The closed end 216 of the first housing section 211 may be rounded, sloped, tapered, pointed, beveled, chamfered, and/or otherwise shaped, with respect to the central axis 215 of the laser cutting apparatus 200, such as may decrease drag or friction forces between the laser cutting apparatus 200 and the wellbore 120 and/or wellbore fluid as the laser cutting apparatus 200 is moved through the wellbore 120. The first housing section 211 may further comprise a window 213, such as may permit transmission of a laser beam 290. The window 213 may include an optically transparent material, such as a lens, glass, or a transparent polymer, or the window 213 may be an aperture extending through a sidewall of the first housing section 211. The window 213 may have a substantially circular, elongated, or otherwise shaped cross-sectional area, such as a slot extending circumferentially around the sidewall of the first housing section 211.

The second housing section 212 may comprise a plurality of ports 214 extending from the internal space 205 of the housing 110 to the exterior of the cutting apparatus 200 (e.g., the wellbore 120). During laser cutting operations, fluid communicated through the coiled tubing 161 may be introduced into the internal space 205 of the second housing section 212. The second housing section 212 may further comprise one or more fluid pathways 218 extending between the uphole portion of the internal space 205 and a downhole portion of the internal space 205 encompassed by the first housing section 211, such as may be operable to communicate fluid during laser cutting operations. The fluid may be directed as shown by arrows 202 and 203 in FIGS. 2A and 2B, such as may remove or displace wellbore fluid, rock debris, and/or other loose particles (e.g., dislodged from the formation 130) from the area surrounding the deflection system 250 and/or the radial slots 132, which may aid in preventing the wellbore fluid and/or debris from diffusing or otherwise interfering with the laser beam 290.

For example, the fluid may be expelled through the ports 214 into the wellbore 120, as shown by arrows 202. FIG. 2B further shows the fluid being expelled through the fluid pathway 218 and circulated through and/or around the deflection system 250 after a downhole portion of the first housing section 211 has been removed, as shown by arrows 203. During laser cutting operations, the fluid may remove or displace wellbore fluid, rock debris, and/or loose particles (e.g., dislodged from the formation 130) from the area surrounding the deflection system 250 and the area between the deflection system 250 and the surface of the wellbore 120 being cut by the laser beam 290. The ports 214 may be located or extend closer to the deflection system 250 than depicted. Also, the ports 214 and/or the fluid pathway 218 may be omitted from the laser cutting apparatus 200 and/or be selectively closed during laser cutting operations.

The fluid expelled through the ports 214 and the fluid pathway 218 may be transparent to the laser beam 290, such as in implementations in which the fluid may comprise nitrogen, water with an appropriate composition and salinity, and/or another fluid that does not deleteriously interfere with the laser beam 290. Such fluid may also help or improve penetration of the laser beam 290 by displacing gasses formed/released during the laser cutting operations, while permitting the laser beam 290 to pass therethrough and impinge upon the formation 130. The fluid composition may depend on the wavelength of the laser beam 290. For example, the spectrum of absorption of water for infrared light may have some wavelength intervals where water is substantially transparent to the laser beam 290. The laser cutting apparatus 200 may be operable to emit a laser beam 290 having a wavelength that may be transmitted through the water with little or no interference.

The laser cutting apparatus 200 may be operable to receive therein or otherwise couple with the optical conductor 191 or other conductor operable for transmitting or conducting the laser beam 290 from the laser source 190. The laser cutting apparatus 200 comprises the deflection system 250 operable to deflect and/or otherwise change the direction of the laser beam 290 emitted from the optical conductor 191. For example, the deflection system 250 may be operable to direct the laser beam 290 through the window 213 of the first housing section 211 and incident upon the casing 122, the cement sheath 124, and the formation 130. The deflection system 250 may rotate about the first axis 251 and about a second axis 252, which may be located at a distance 253 from the first axis 251. The first and second axes 251, 252 may be substantially parallel with respect to each other, such that the second axis 252 is located between the central axis 215 and the outer wall of the housing 110.

The deflection system 250 may comprise a first deflector 254 and a second deflector 257. The first deflector 254 may be operable for rotation about the first axis 251, and the second deflector 257 may be operable for rotation about the second axis 252. The first deflector 254 may be rotated by a first motor 261, such as an electrical stepper motor and/or other motor comprising a first stator 262, which may be fixedly connected with the housing 210, and a first rotor 263, which may be connected with a first base portion 255 of the first deflector 254. The second deflector 257 may be rotated by a second motor 265, such as an electrical stepper motor and/or other motor comprising a second stator 266, which may be fixedly connected with the first base portion 255 of the first deflector 254, and a second rotor 267, which may be connected with a second base portion 258 of the second deflector 257. As the second stator 266 may be directly or indirectly connected with the first base 255 of the first deflector 254, the second deflector 257 may also be operable for rotation about the first axis 251.

The first deflector 254 may optically interpose the optical conductor 191 and the second deflector 257. For example, the first deflector 254 may include a first deflector portion 256 operable to focus, bend, reflect, or otherwise direct the laser beam 290 emitted from the optical conductor 191 toward a second deflector portion 259 of the second deflector 257. The second deflector portion 259 may be operable to direct the laser beam 290 through the window 213 of the first housing section 211 to be incident upon the casing 122, the cement sheath 124, and/or the formation 130. The first and second deflector portions 256, 259 may each comprise a lens, prism, mirror, or other optical member operable to direct the laser beam 290 in the intended direction. The second deflector portion 259 may deflect the laser beam 290 two or more times or in two or more directions. For example, the second deflector portion 259 may comprise two or more prisms, two or more mirrors, or may be or comprise a rhomboid prism, among other example implementations also within the scope of the present disclosure.

The laser cutting apparatus 200 may further comprise a controller 220 disposed within the housing 210. The laser cutting apparatus 200 may also be operable to receive therein or otherwise connect with the electrical conductor 181 or other conductor operable for transmitting or conducting electrical signals from the control center/source of electrical power 180. For example, the controller 250 may be operable to electrically connect with the electrical conductor 181, to process signals received from the control center/source of electrical power 180 via the electrical conductor 181, and/or to control the rotational position of the first and second motors 261, 265 based on the signals received. The controller 220 may be further operable to receive and process signals from a CCL and/or orientation sensor described above, such as to acquire the position and/or the orientation of the laser cutting apparatus 200. The controller 220 may be operable to transmit such signals or the acquired position and/or orientation of the laser cutting apparatus 200 to the control center/source of electrical power 180 via the electrical conductor 181. The controller 220 may also be operable to receive and process signals from the control center/source of electrical power 180 to extend and/or retract the anchoring device 115.

As shown in FIG. 2A, the first housing section 211 of the laser cutting apparatus 200 may be or comprise a non-rotatable protection cover coupled with the second housing section 212. The first housing section 211 may enclose and protect the deflection system 250 as the laser cutting apparatus 200 is conveyed downhole through the wellbore 120 toward a predetermined location within the wellbore 120. For example, the first housing section may threadedly connect with the second housing section 212 or the first and second housing sections 211, 212 may connect by other connection means. The first housing section may comprise a similar configuration as depicted in FIG. 2A, however the first housing section 211 may not comprise openings (such as the window 213) exposed to the wellbore 120, such that the first housing section 211 may isolate the deflection system 250 from wellbore fluids and formation particles and/or prevent wellbore fluids and formation particles from entering the internal space 205. The first housing section 211 may comprise drillable material, such as aluminum and/or other material that may be cut by the laser beam 290.

During cutting operations, laser cutting apparatus 200 may be conveyed to the deepest position within the wellbore 120 at which radial slots 132 are to be formed. For example, a first activation of the laser beam 290 may form a radial slot 132 at or near the bottom end of the wellbore 120. During this first operation, at least a portion (e.g., an end portion) of the first housing section 211 may be cut off as a result of rotating the deflection system 250 (and thus the laser beam 290) through 360 degrees of rotation, causing the portion of the first housing section 211 to fall off into the wellbore 120. The laser beam 290, directed by the deflection system 250, may then be free to impinge upon the side of the wellbore 120, including the casing 122, the cement 124, and the formation 130, to form a first set of radial slots 132. Thereafter, the tool string 110, including the laser cutting apparatus 200, may be moved along the wellbore 120 in the uphole direction until the laser cutting apparatus 200 is positioned at the next predetermined location at which another set of radial slots 132 are to be formed. The above-described process may be repeated until each of the intended radial slots 132 are created, and the laser cutting apparatus 200 may then be removed from the wellbore 120. Limiting movement of the laser cutting apparatus 200 in the uphole direction after the end portion is cut off may prevent or minimize contact between the deflection system 250 and the side of the wellbore 120 or other obstacles in the wellbore, such as may prevent or minimize damage to the deflection system 250 that might otherwise occur if the laser cutting apparatus 200 is moved in the downhole direction after the end portion is cut off.

Figure 2C:
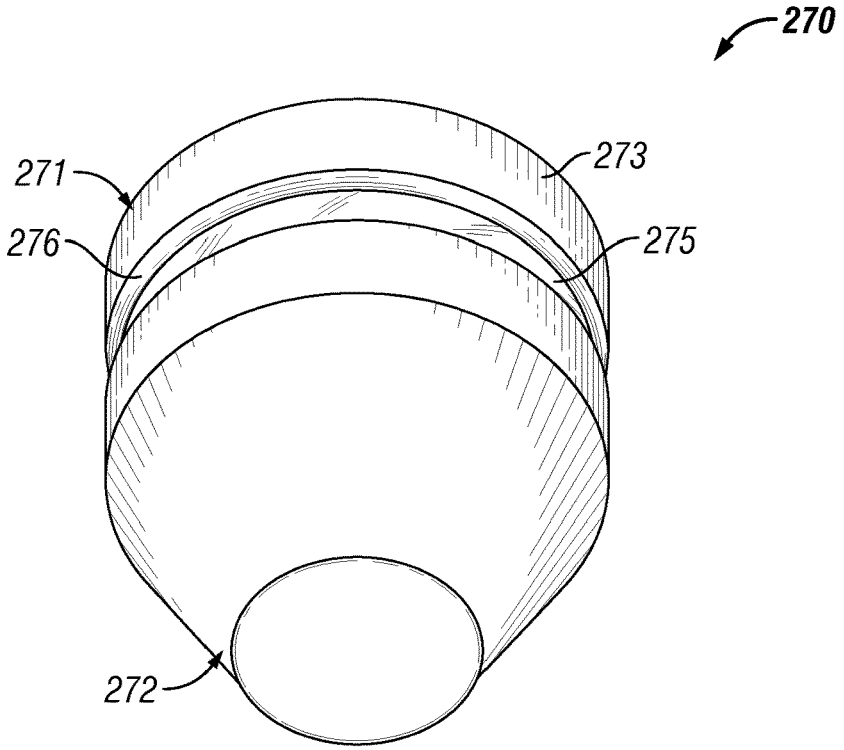
FIG. 2C is a perspective view of a portion of an example implementation of the apparatus shown in FIG. 1 according to one or more aspects of the present disclosure.
Figure 2D:
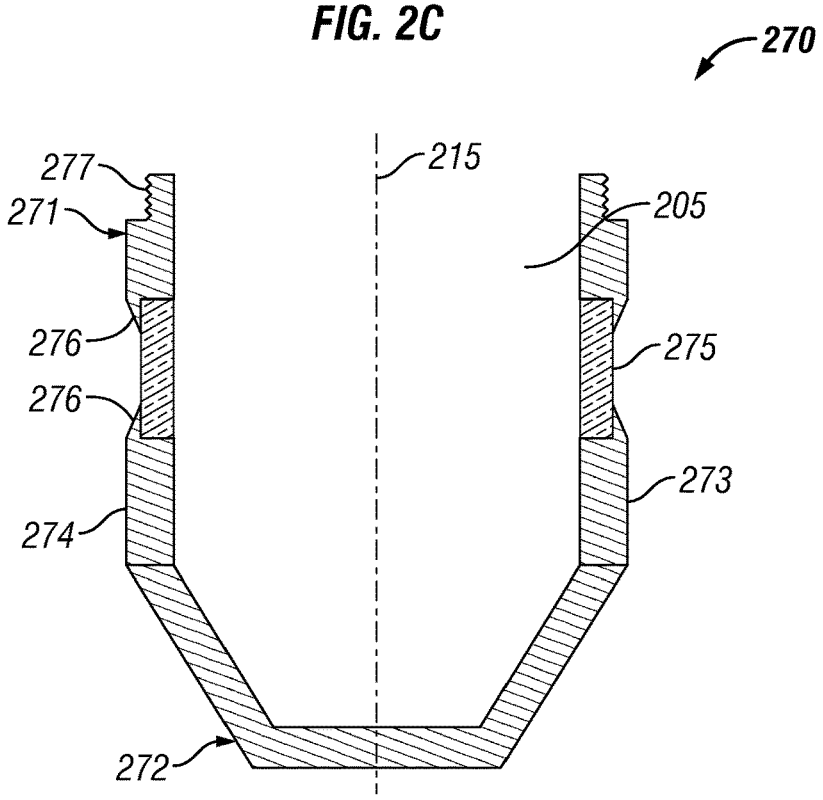
FIG. 2D is a sectional view of the apparatus shown in FIG. 2C according to one or more aspects of the present disclosure.

FIG. 2C is a perspective view of a portion of an example implementation of the laser cutting apparatus 200 shown in FIG. 1 according to one or more aspects of the present disclosure. FIG. 2D is a sectional view of the apparatus shown in FIG. 2C according to one or more aspects of the present disclosure. Referring collectively to FIGS. 1, 2A, 2C, and 2D, the laser cutting apparatus 200 may comprise another implementation of the first housing section 270, also referred to herein as a protection cover. The first housing section 270 may be operable to enclose a downhole portion of the laser cutting apparatus 200 and protect certain components of the laser cutting apparatus 200, including the deflection system 250, such as when the laser cutting apparatus 200 is conveyed downhole through the wellbore 120 to a predetermined location. The first housing section 270 may also be operable to prevent wellbore fluid from communicating into the interior space 205 of the laser cutting apparatus 200.

The first housing section 270 may be disposed at the downhole end of the laser cutting apparatus 200, and may comprise an open end 271 and a closed end 272. The closed end 272 may be conical, hemispherical, bowl-shaped, or otherwise shaped, with respect to the central axis 215 of the laser cutting apparatus 200, such as may decrease drag or friction forces between the laser cutting apparatus 200 and the wellbore 120 and/or wellbore fluid as the laser cutting apparatus 200 is conveyed through the wellbore 120. The first housing section 270 may be fixedly connected with a downhole end of the second housing section 212 by various means. For example, the open end 271 may comprise threads 277 that may engage corresponding threads (not shown) of the second housing section 212.

The first housing section 270 may further comprise a window 275 extending therethrough, such as may permit transmission of the laser beam 290 out of the first housing section 270 through 360 degrees of rotation as the deflection system 250 rotates. The window 275 may comprise a solid ring configuration extending circumferentially 360 degrees about the first housing section 270 adjacent the open end 271, and may comprise a width sufficient to permit transmission of the laser beam 290. The window 275 may be recessed with respect to the outer surface 273 of the first housing section 270, such as may prevent or reduce contact between the window 275 and the sidewalls of the wellbore 120, for example, when the laser cutting apparatus 200 is conveyed through the wellbore 120. The window 275 may comprise glass, a transparent polymer, a material forming the first and second deflector portions 256, 259, and/or other material that is transparent to the laser beam 290. The window 275 may be seated and/or sealed against shoulders 276 within the wall 274 of the first housing section 270, such as may retain the window 275 in position and aid in preventing or minimizing contaminants or wellbore fluid from entering into the interior space 205 of the laser cutting apparatus 200. The window 275 may be connected with or retained within the wall 274 by adhesive, threaded fasteners, interference/press fit, and/or other means. The wall 274 and the window 275 may comprise thicknesses or other design features that may aid in permitting the wall 274 and the window 275 to withstand high pressures exerted by fluids in the wellbore 120.

During operations, and/or when the first housing section 270 is coupled with the second housing section 212, the internal space 205 of the first housing section 270 may be filled with a fluid transparent to the laser beam 290, such as nitrogen or a suitable liquid permitting uninterrupted transmission of the laser beam 290 through the internal space 205 of the first housing section 270. Instead of being filled with a fluid, the internal space 205 of the first housing section 270 may comprise vacuum, which may also permit uninterrupted transmission of the laser beam 290 through the internal space 205 of the first housing section 270.

FIGS. 3A, 4A, 5A, and 6A are enlarged sectional end views (as viewed in the uphole direction) of a portion of the example implementation of the laser cutting apparatus 200 shown in FIGS. 1, 2A, and 2B according to one or more aspects of the present disclosure. FIGS. 3B, 4B, 5B, and 6B are sectional end views corresponding to FIGS. 3A, 4A, 5A, and 6A, respectively, where such correspondence will be described below. In general, FIGS. 3A, 3B, 4A, 4B, 5A, 5B, 6A, and 6B are enlarged sectional views of the first and second deflectors 254, 257 at different relative positions and orientations at different stages of cutting operations.

Figure 3A:
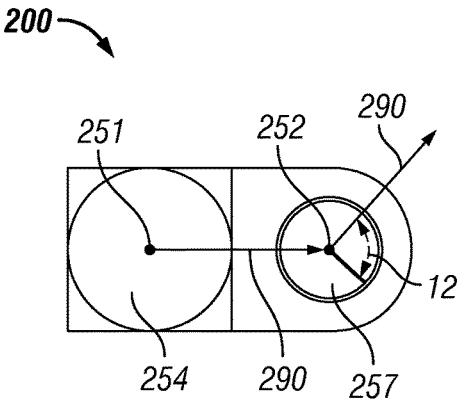
FIGS. 3A, 4A, 5A, and 6A are enlarged sectional views of a portion of an example implementation of the apparatus shown in FIG. 1 at different stages of operation according to one or more aspects of the present disclosure.
Figure 3B:
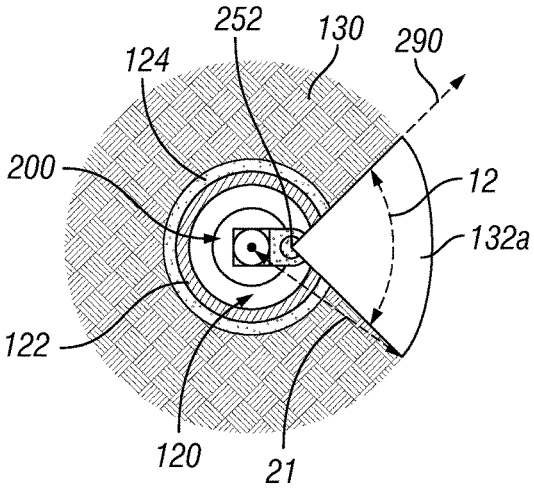
FIGS. 3B, 4B, 5B, and 6B are sectional views of a portion of an example implementation of the apparatus shown in FIG. 1 at different stages of operation according to one or more aspects of the present disclosure.

FIG. 3A depicts the first deflector 254, having the first axis of rotation 251, and the second deflector 257, having the second axis of rotation 252, wherein the second deflector 257 is disposed at a first position with respect to the first deflector 254. The first deflector 254 is depicted as directing the laser beam 290 toward the second deflector 257, which is rotated to direct the laser beam 290 through an angle 12 of about ninety degrees. FIG. 3B depicts the laser cutting apparatus 200 shown in FIG. 3A but disposed in the wellbore 120 that extends into the formation 130. FIG. 3B also depicts the second deflector 257 rotating about the second axis of rotation 252 to direct the laser beam 290 to be incident upon the casing 122, the cement sheath 124, and the formation 130 along an angle 12 of about ninety degrees, thereby forming a first slot 132*a* extending within the formation 130 through the angle 12, including into the formation 130 to the linear distance 21 with respect to the first axis of rotation 251.

Figure 4A:
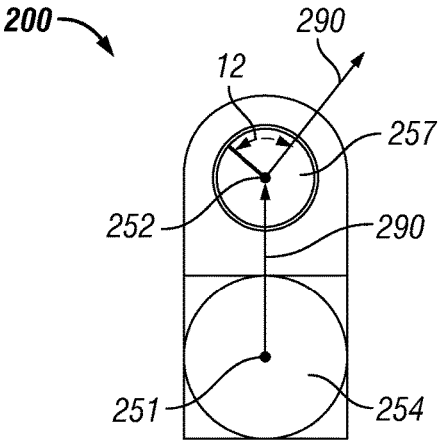
Figure 4B:
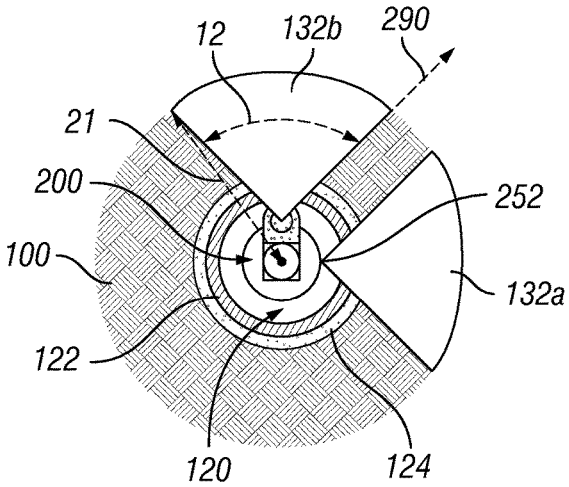

FIG. 4A depicts a subsequent stage of operation in which the first deflector 254 has been rotated about the first axis of rotation 251 by about ninety degrees relative to its position depicted in FIG. 3A, resulting in the second deflector 257 also being rotated by about ninety degrees about the first axis of rotation 251 to a second position. As above, the first deflector 254 directs the laser beam 290 toward the second deflector 257, which in turn rotates about the second axis of rotation 252 to direct the laser beam 290 through an angle 12 of about ninety degrees. FIG. 4B depicts the laser cutting apparatus 200 shown in FIG. 4A disposed in the wellbore 120, with the second deflector 257 rotating about the second axis of rotation 252 and directing the laser beam 290 to be incident upon the casing 122, the cement sheath 124, and the formation 130 along an angle 12 of about ninety degrees to form a second slot 132*b* extending within the formation 130 through the angle 12, including into the formation 130 to the linear distance 21 with respect to the first axis of rotation 251.

Figure 5A:
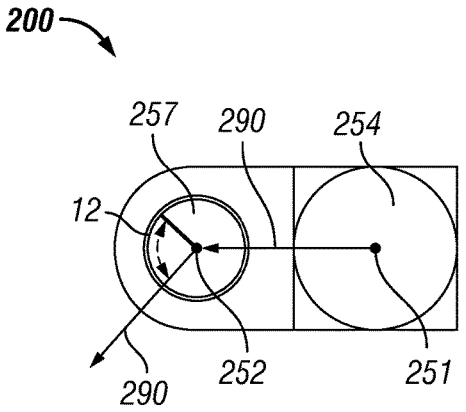
Figure 5B:
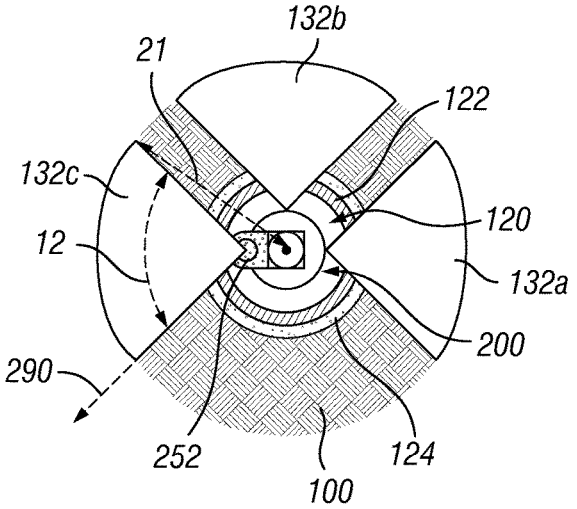

FIG. 5A depicts a subsequent stage of operation in which the first deflector 254 has again been rotated about the first axis of rotation 251 by about ninety degrees relative to its position depicted in FIG. 4A, resulting in the second deflector 257 also being rotated again by about ninety degrees about the first axis of rotation 251 to a third position. As above, the first deflector 254 directs the laser beam 290 toward the second deflector 257, which in turn rotates about the second axis of rotation 252 to direct the laser beam 290 through an angle 12 of about ninety degrees. FIG. 5B depicts the laser cutting apparatus 200 shown in FIG. 5A disposed in the wellbore 120, with the second deflector 257 rotating about the second axis of rotation 252 and directing the laser beam 290 to be incident upon the casing 122, the cement sheath 124, and the formation 130 along an angle 12 of about ninety degrees to form a third slot 132*c* extending within the formation 130 through the angle 12, including into the formation 130 to the linear distance 21 with respect to the first axis of rotation 251.

Figure 6A:
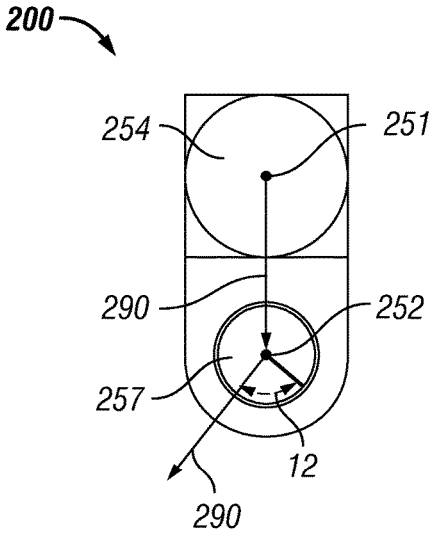
Figure 6B:
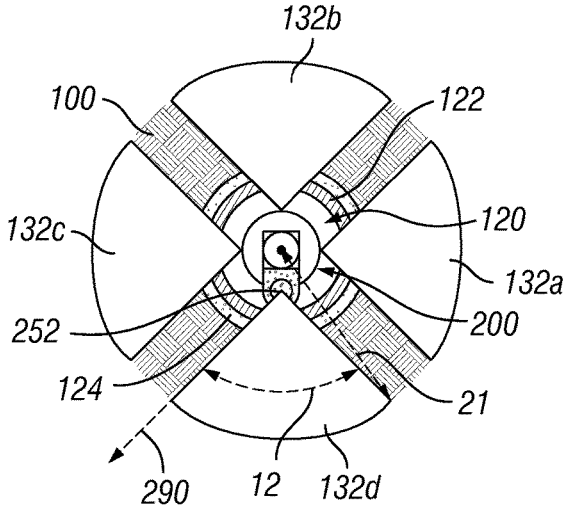

FIG. 6A depicts a subsequent stage of operation in which the first deflector 254 has again been rotated about the first axis of rotation 251 by about ninety degrees relative to its position depicted in FIG. 5A, resulting in the second deflector 257 also being rotated again by about ninety degrees about the first axis of rotation 251 to a fourth position. As above, the first deflector 254 directs the laser beam 290 toward the second deflector 257, which in turn rotates about the second axis of rotation 252 to direct the laser beam 290 through an angle 12 of about ninety degrees. FIG. 6B depicts the laser cutting apparatus 200 shown in FIG. 6A disposed in the wellbore 120, with the second deflector 257 rotating about the second axis of rotation 252 and directing the laser beam 290 to be incident upon the casing 122, the cement sheath 124, and the formation 130 along an angle 12 of about ninety degrees to form a fourth slot 132*d* extending within the formation 130 through the angle 12, including into the formation 130 to the linear distance 21 with respect to the first axis of rotation 251.

Figure 7:
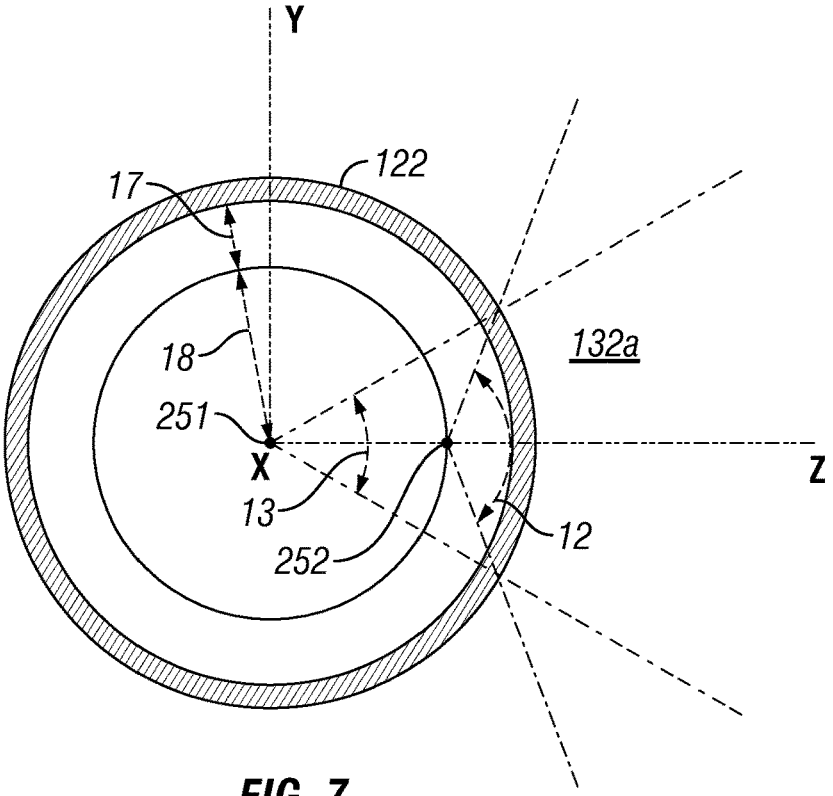
FIG. 7 is a schematic view of a portion of an example implementation of the apparatus shown in FIGS. 3A and 3B according to one or more aspects of the present disclosure.

FIG. 7 is a schematic view of at least a portion of an example implementation of the laser cutting system 100 shown in FIGS. 1, 2A, and 3B according to one or more aspects of the present disclosure. FIG. 7 depicts a geometric relationship between positions of the first and second deflectors 254, 257 (not shown in FIG. 7) disposed about the first and second axes of rotation 251, 252, the position of the casing 122, the angle 12 through which the second deflector 257 rotates about the second axis of rotation 252, and an angle 13 through which the first deflector 254 may rotate about the first axis of rotation 251.

Figure 8:
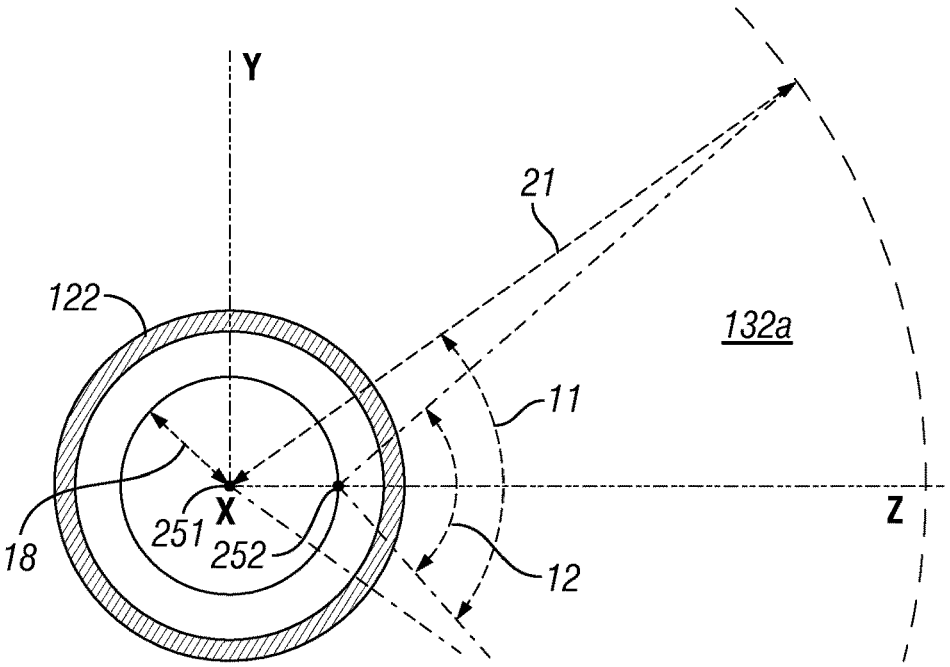
FIG. 8 is a schematic view of a portion of an example implementation of the apparatus shown in FIGS. 3A and 3B according to one or more aspects of the present disclosure.

The angle 12 may be defined as the angle through which the radial slot 132*a* extends with respect to the second axis of rotation 252. The angle 13 may be defined as the angle through which the radial slot 132*a* extends through the casing 122 with respect to the first axis of rotation 251. For example, for a predetermined angle 13, the angle 12 increases as the position of the second axis of rotation 252 is moved closer to the casing 122 or is moved further away from the first axis of rotation 251. Thus, the angle 12 may be increased by increasing the radial distance 18 between the first axis of rotation 251 and the second axis of rotation 252, and/or by decreasing the radial distance 17 between the second axis of rotation 252 and the casing 122, while maintaining the angle 13. FIG. 8 is a schematic view similar to FIG. 7 and depicting a geometric relationship between the angles 11, 12 and the radial distances 18, 21. As described above, the radial distance 21 may be defined as the radial depth of the radial slot 132*a* measured from the first axis of rotation 251, and the radial distance 18 may be defined as the linear distance between the first axis of rotation 251 and the second axis of rotation 252. The angle 11 may be defined as the angle through which the radial slot 132*a* extends with respect to the second axis of rotation 252 relative to the radial distance 21. FIG. 8 illustrates that, for a given radial distance 21, the angle 11 may be increased by increasing the angle 12 or by increasing the radial distance 18. FIGS. 7 and 8 collectively illustrate that the angles 11 and 13 may relate to the angle 12 and/or the radial distance 18, such that the angles 11 and 13 may be adjusted by adjusting the angle 12 and/or the radial distance 18.

Figure 9:
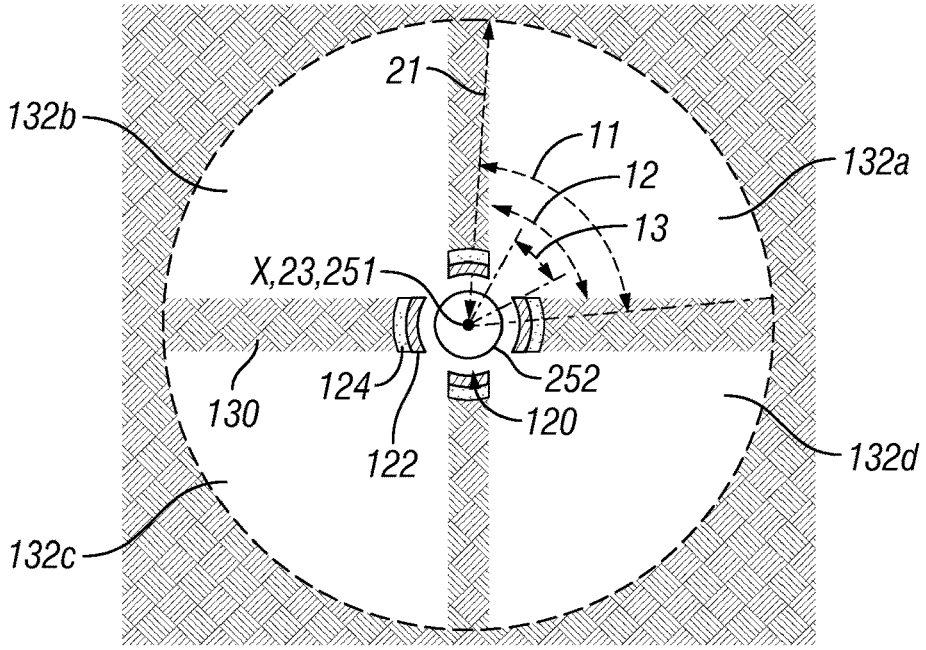
FIG. 9 is a sectional view of a portion of an example implementation of the apparatus shown in FIG. 1 according to one or more aspects of the present disclosure.

FIG. 9 is a sectional view of at least a portion of the example implementation of the laser cutting system 100 shown in FIGS. 1, 2A, and 2B according to one or more aspects of the present disclosure, depicting an example radial slot configuration cut in the casing 122, the cement sheath 124, and the formation 130, such as may be formed by the process described above and depicted in FIGS. 3A-6B. The depicted slot configuration includes four radial slots 132*a-d* each extending into the formation 130 through an angle 12 of about ninety degrees with respect to the second axis of rotation 252. The outer boundaries of each slot 132*a-d* at the radial distance 21 (relative to the first axis of rotation 251) extend through an angle 11 of about eighty degrees with respect to the first axis of rotation 251. Each radial slot 132*a-d* extends through the casing 122 through an angle 13 of about 45 degrees with respect to the first axis of rotation 251. Therefore, if the first axis of rotation 251 substantially coincides with the wellbore axis 23 (i.e., the X-axis in FIG. 1), the cumulative angle through which the radial slots 132*a-d* extend within the formation 130 at the radial distance 21 is about 320 degrees with respect to the wellbore axis 23, while the cumulative angle through which the radial slots 132*a-d* extend through the casing 122 is about 180 degrees with respect to the wellbore axis 23. Thus, by utilizing the second deflector 257 offset from the central axis 215 of the laser cutting apparatus 200, the radial slots 132*a-d* may extend through a desired angular portion of the formation 130 while minimizing the amount of material removed from the casing 122, such that the casing 122 is not severed.

Figure 10:
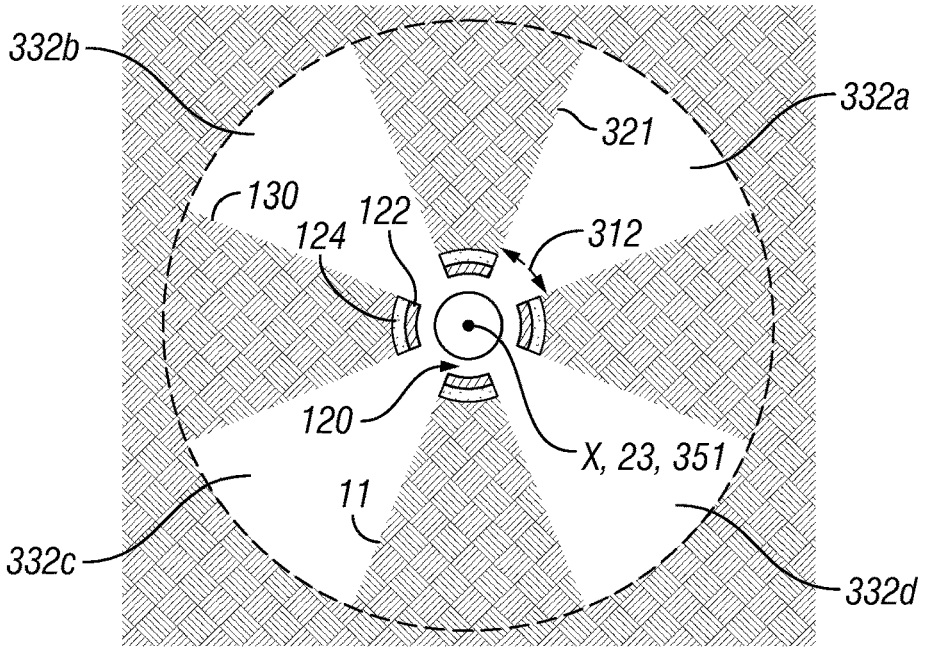
FIG. 10 (Prior Art)
FIG. 10 is a sectional view of prior art apparatus.

In contrast, FIG. 10 is a sectional view of radial slots 332*a-d* that may be achieved with a prior art laser cutter (not shown) comprising a laser emitter with a single axis of rotation 351, which coincides with the wellbore axis 23. Each radial slot 332*a-d* extends through the casing 122 and into the formation 130 through the same angle 312 with respect to the single axis of rotation 351. FIG. 10 illustrates that utilizing a laser cutter having a single axis of rotation to form radial slots extending into a formation through a sufficient angle would remove an excessive amount of the casing. In contrast, as shown in FIG. 9 (among others), utilizing a laser cutting apparatus having a second deflector 257 offset from the first reflector 254 permits forming radial slots extending into the formation through a sufficient angle without removing an excessive amount of the casing.

Figure 11:
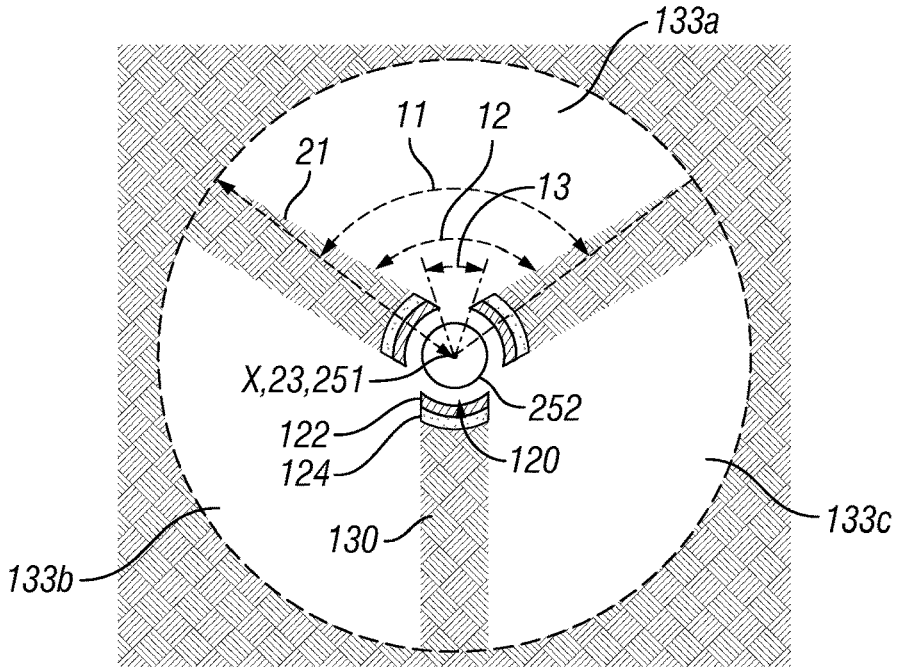
FIG. 11 is a sectional view of a portion of an example implementation of the apparatus shown in FIG. 1 according to one or more aspects of the present disclosure.
Figure 12:
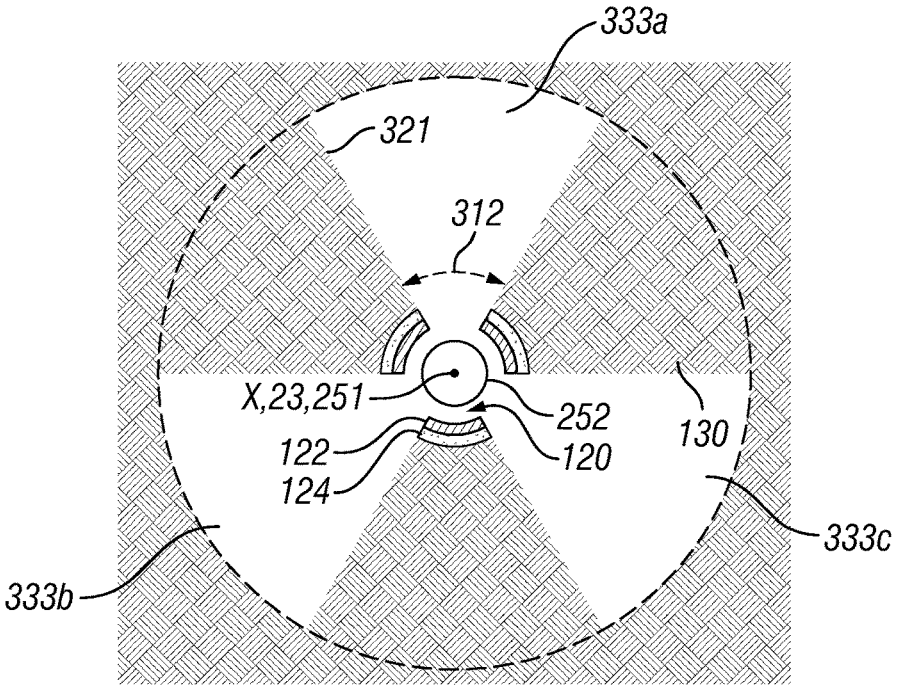
FIG. 12 (Prior Art)
FIG. 12 is a sectional view of prior art apparatus.

FIG. 11 is a sectional view of another example implementation utilizing the laser cutting system 100 shown in FIGS. 1, 2A, and 2B according to one or more aspects of the present disclosure, in which three radial slots 133*a-c* each extend into the formation 130 through an angle 12 of about 120 degrees with respect to the second axis of rotation 252, such that outer boundaries of the radial slots 133*a-c* at the radial distance 21 extend through an angle 11 of about 105 degrees with respect to the first axis of rotation 251. Each radial slot 133*a-c* extends through the casing 122 an angle 13 of about sixty degrees with respect to the first axis of rotation 251. Therefore, if the first axis of rotation 251 substantially coincides with the wellbore axis 23, the cumulative angle through which the radial slots 133*a-c* extend through the formation 130 at the radial distance 21 is about 315 degrees, whereas the cumulative angle through which the radial slots 133*a-c* extend through the casing 122 is limited to about 180 degrees. In contrast, as shown in FIG. 12 depicting the prior art implementation described above, the largest radial slots 333*a-c* possible with a single-axis laser cutter without removing additional material from the casing 122 would each extend through an angle 312 of about 45 degrees. Thus, the cumulative angle through which the radial slots 333*a-c* formed with a single-axis laser cutter would extend is about 135 degrees, which is substantially less than the 315 degrees formed with the laser cutting apparatus 200 and depicted in FIG. 11.

Figure 13:
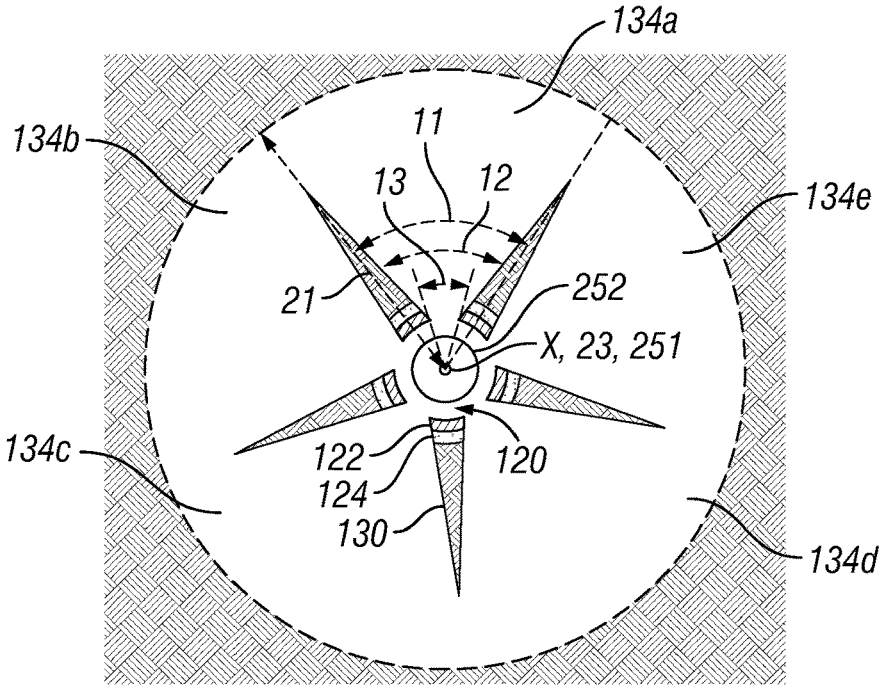
FIG. 13 is a sectional view of a portion of an example implementation of the apparatus shown in FIG. 1 according to one or more aspects of the present disclosure.
Figure 14:
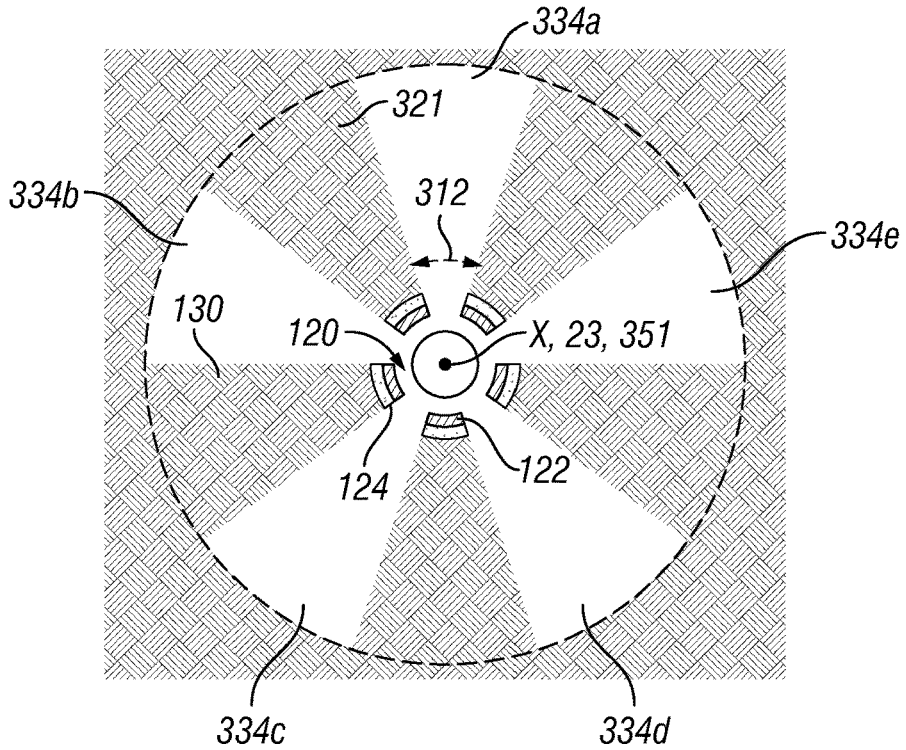
FIG. 14 (Prior Art)
FIG. 14 is a sectional view of prior art apparatus.

FIG. 13 is a sectional view of another example implementation utilizing the laser cutting system 100 shown in FIGS. 1, 2A, and 2B according to one or more aspects of the present disclosure, in which five radial slots 134*a-e* each extend into the formation 130 through an angle 12 of about 85 degrees with respect to the second axis of rotation 252, such that outer boundaries of the radial slots 134*a-e* at the radial distance 21 extend through an angle 11 of about 75 degrees with respect to the first axis of rotation 251. Each radial slot 134*a-e* extends through the casing 122 by an angle 13 of about forty degrees with respect to the first axis of rotation 251. Therefore, if the first axis of rotation 251 substantially coincides with the wellbore axis 23, the cumulative angle through which the radial slots 134*a-e* extending through the formation 130 at the radial distance 21 is about 375 degrees, whereas the cumulative angle through which the radial slots 134*a-e* extending through the casing 122 is limited to about 200 degrees. Accordingly, a substantially continuous 360 degree cut may be made through the formation 130 at the radial distance 21, while avoiding cutting the casing 122 over 360 degrees, thereby maintaining casing integrity. In contrast, as shown in FIG. 14 depicting the prior art implementation described above, the largest radial slots 334*a-e* possible with a single-axis laser cutter without removing additional material from the casing 122 would each extend through an angle 312 of about forty degrees. Thus, the cumulative angle through which the radial slots 334*a-e* formed with a single-axis laser cutter would extend is about 200 degrees, which is substantially less than the substantially continuous 360 degree cut formed with the laser cutting apparatus 200 and depicted in FIG. 13.

Tables 1-4 set forth below list example values of b, the half-angle of the angle 12 through which the second deflector may be rotated to form a radial slot in the casing 122, compared to corresponding example values of a, the half-angle of the angle 13 through which the first deflector may be rotated to form the same radial slot in the casing 122, for several example values of a ratio R/r. The variable R is the outer radius of the casing 122, such as the sum of: (1) the radial distance 17 between the second axis of rotation 252 and the outer surface of the casing 122; and (2) the radial distance 18 between the first and second axes of rotation 251, 252. The variable r is the radial distance 18 between the first and second axes of rotation 251, 252. For example, at R/r=1.43, which is approximately the ratio utilized for the example implementations depicted in FIGS. 9, 11, and 13, and for a half-angle a of 22.5 degrees, the half-angle b is 48.33 degrees.

TABLE 1

| R/r = | 1.10 | 1.11 | 1.12 | 1.13 | 1.14 | 1.15 | 1.16 | 1.17 | 1.18 | 1.19 |
|---|---|---|---|---|---|---|---|---|---|---|
| a | b | b | b | b | b | b | b | b | b | b |
| 5 | 42.19 | 39.39 | 36.89 | 34.65 | 32.63 | 30.82 | 29.18 | 27.69 | 26.33 | 25.10 |
| 10 | 64.06 | 61.46 | 58.98 | 56.62 | 54.39 | 52.28 | 50.27 | 48.38 | 46.60 | 44.91 |
| 15 | 75.99 | 73.93 | 71.92 | 69.95 | 68.04 | 66.17 | 64.36 | 62.60 | 60.89 | 59.25 |
| 20 | 84.03 | 82.39 | 80.76 | 79.15 | 77.55 | 75.98 | 74.43 | 72.90 | 71.40 | 69.93 |
| 22.5 | 87.37 | 85.88 | 84.40 | 82.93 | 81.48 | 80.03 | 78.60 | 77.18 | 75.79 | 74.41 |
| 30 | 96.30 | 95.14 | 93.99 | 92.84 | 91.69 | 90.54 | 89.39 | 88.25 | 87.11 | 85.98 |

TABLE 2

| R/r = | 1.20 | 1.21 | 1.22 | 1.23 | 1.24 | 1.25 | 1.26 | 1.27 | 1.28 | 1.29 |
|---|---|---|---|---|---|---|---|---|---|---|
| a | b | b | b | b | b | b | b | b | b | b |
| 5 | 23.97 | 22.93 | 21.97 | 21.09 | 20.27 | 19.51 | 18.80 | 18.14 | 17.53 | 16.95 |
| 10 | 43.32 | 41.82 | 40.40 | 39.06 | 37.79 | 36.59 | 35.46 | 34.38 | 33.36 | 32.40 |
| 15 | 57.65 | 56.11 | 54.63 | 53.20 | 51.82 | 50.49 | 49.21 | 47.98 | 46.80 | 45.66 |
| 20 | 68.49 | 67.07 | 65.69 | 64.33 | 63.01 | 61.72 | 60.46 | 59.23 | 58.03 | 56.86 |
| 22.5 | 73.05 | 71.71 | 70.40 | 69.10 | 67.83 | 66.58 | 65.36 | 64.16 | 62.99 | 61.84 |
| 30 | 84.86 | 83.74 | 82.62 | 81.52 | 80.43 | 79.34 | 78.26 | 77.20 | 76.15 | 75.10 |

TABLE 3

| R/r = | 1.30 | 1.31 | 1.32 | 1.33 | 1.34 | 1.35 | 1.36 | 1.37 | 1.38 | 1.39 |
|---|---|---|---|---|---|---|---|---|---|---|
| a | b | b | b | b | b | b | b | b | b | b |
| 5 | 16.41 | 15.90 | 15.42 | 14.97 | 14.55 | 14.14 | 13.76 | 13.40 | 13.06 | 12.73 |
| 10 | 31.48 | 30.61 | 29.78 | 28.99 | 28.24 | 27.52 | 26.84 | 26.18 | 25.56 | 24.96 |
| 15 | 44.56 | 43.51 | 42.49 | 41.51 | 40.57 | 39.67 | 38.79 | 37.95 | 37.14 | 36.36 |
| 20 | 55.73 | 54.62 | 53.55 | 52.51 | 51.49 | 50.50 | 49.54 | 48.61 | 47.70 | 46.82 |
| 22.5 | 60.72 | 59.62 | 58.55 | 57.50 | 56.48 | 55.48 | 54.51 | 53.56 | 52.63 | 51.72 |
| 30 | 74.07 | 73.05 | 72.05 | 71.06 | 70.08 | 69.11 | 68.16 | 67.22 | 66.30 | 65.39 |

TABLE 4

| R/r = | 1.40 | 1.41 | 1.42 | 1.43 | 1.44 | 1.45 | 1.46 | 1.47 | 1.48 | 1.49 |
|---|---|---|---|---|---|---|---|---|---|---|
| a | b | b | b | b | b | b | b | b | b | b |
| 5 | 12.42 | 12.12 | 11.84 | 11.57 | 11.31 | 11.07 | 10.83 | 10.60 | 10.38 | 10.18 |
| 10 | 24.39 | 23.85 | 23.32 | 22.82 | 22.34 | 21.87 | 21.43 | 21.00 | 20.59 | 20.19 |
| 15 | 35.61 | 34.89 | 34.19 | 33.51 | 32.86 | 32.23 | 31.62 | 31.03 | 30.46 | 29.91 |
| 20 | 45.97 | 45.14 | 44.33 | 43.55 | 42.79 | 42.05 | 41.33 | 40.63 | 39.95 | 39.29 |
| 22.5 | 50.84 | 49.98 | 49.14 | 48.33 | 47.53 | 46.76 | 46.00 | 45.26 | 44.54 | 43.84 |
| 30 | 64.50 | 63.62 | 62.75 | 61.90 | 61.06 | 60.24 | 59.43 | 58.64 | 57.86 | 57.09 |

However, Tables 1-4 merely provide example values, and many other values are also within the scope of the present disclosure.

Tables 5 and 6 set forth below list example values of the half-angle b through which the second deflector may be rotated to form a radial slot in the formation at the radial distance 21 (penetration depth D), compared to corresponding example values of B, the half-angle of the angle 11 through which the first deflector would be rotated to form the radial slot in the formation with a single-axis laser cutting apparatus, for several example values of the ratio r/D.

TABLE 5

| r/D = B | 0.25 b | 0.26 b | 0.27 b | 0.28 b | 0.29 b | 0.30 b | 0.31 b | 0.32 b | 0.33 b | 0.34 b |
|---|---|---|---|---|---|---|---|---|---|---|
| 10 | 13.30 | 13.47 | 13.65 | 13.84 | 14.03 | 14.23 | 14.43 | 14.64 | 14.85 | 15.07 |
| 15 | 19.88 | 20.13 | 20.40 | 20.67 | 20.95 | 21.24 | 21.53 | 21.84 | 22.15 | 22.46 |
| 20 | 26.38 | 26.71 | 27.05 | 27.40 | 27.76 | 28.13 | 28.51 | 28.90 | 29.29 | 29.70 |
| 25 | 32.78 | 33.18 | 33.59 | 34.01 | 34.44 | 34.88 | 35.33 | 35.78 | 36.25 | 36.73 |
| 30 | 39.06 | 39.52 | 39.99 | 40.47 | 40.96 | 41.46 | 41.96 | 42.48 | 43.01 | 43.55 |
| 35 | 45.22 | 45.73 | 46.25 | 46.77 | 47.31 | 47.85 | 48.41 | 48.97 | 49.54 | 50.13 |
| 40 | 51.24 | 51.79 | 52.34 | 52.91 | 53.48 | 54.06 | 54.65 | 55.24 | 55.85 | 56.46 |
| 45 | 57.12 | 57.69 | 58.28 | 58.87 | 59.46 | 60.07 | 60.68 | 61.30 | 61.93 | 62.56 |
| 50 | 62.85 | 63.45 | 64.05 | 64.66 | 65.27 | 65.89 | 66.52 | 67.15 | 67.79 | 68.43 |
| 55 | 68.45 | 69.05 | 69.67 | 70.28 | 70.91 | 71.53 | 72.16 | 72.80 | 73.44 | 74.08 |
| 60 | 73.90 | 74.51 | 75.13 | 75.75 | 76.37 | 77.00 | 77.63 | 78.26 | 78.89 | 79.53 |
| 65 | 79.22 | 79.83 | 80.44 | 81.06 | 81.68 | 82.29 | 82.92 | 83.54 | 84.17 | 84.79 |
| 70 | 84.41 | 85.01 | 85.62 | 86.22 | 86.83 | 87.44 | 88.05 | 88.66 | 89.27 | 89.88 |
| 75 | 89.48 | 90.07 | 90.66 | 91.26 | 91.85 | 92.44 | 93.03 | 93.62 | 94.21 | 94.80 |
| 80 | 94.43 | 95.01 | 95.59 | 96.16 | 96.74 | 97.31 | 97.88 | 98.45 | 99.02 | 99.59 |

TABLE 6

| r/D = B | 0.35 b | 0.36 b | 0.37 b | 0.38 b | 0.39 b | 0.40 b | 0.41 b | 0.42 b | 0.43 b | 0.44 b |
|---|---|---|---|---|---|---|---|---|---|---|
| 10 | 15.30 | 15.53 | 15.77 | 16.02 | 16.27 | 16.54 | 16.81 | 17.09 | 17.38 | 17.68 |
| 15 | 22.79 | 23.13 | 23.48 | 23.83 | 24.20 | 24.58 | 24.96 | 25.37 | 25.78 | 26.20 |
| 20 | 30.11 | 30.54 | 30.98 | 31.43 | 31.89 | 32.36 | 32.85 | 33.35 | 33.86 | 34.39 |
| 25 | 37.22 | 37.73 | 38.24 | 38.76 | 39.30 | 39.85 | 40.42 | 40.99 | 41.58 | 42.19 |
| 30 | 44.10 | 44.66 | 45.23 | 45.81 | 46.41 | 47.01 | 47.63 | 48.27 | 48.91 | 49.57 |
| 35 | 50.72 | 51.32 | 51.94 | 52.56 | 53.20 | 53.84 | 54.50 | 55.17 | 55.84 | 56.53 |
| 40 | 57.09 | 57.72 | 58.36 | 59.01 | 59.67 | 60.34 | 61.02 | 61.70 | 62.40 | 63.10 |
| 45 | 63.21 | 63.85 | 64.51 | 65.17 | 65.85 | 66.52 | 67.21 | 67.90 | 68.60 | 69.31 |
| 50 | 69.08 | 69.74 | 70.40 | 71.07 | 71.74 | 72.41 | 73.10 | 73.78 | 74.48 | 75.17 |
| 55 | 74.73 | 75.39 | 76.04 | 76.70 | 77.37 | 78.04 | 78.71 | 79.38 | 80.06 | 80.74 |
| 60 | 80.17 | 80.82 | 81.46 | 82.11 | 82.76 | 83.41 | 84.07 | 84.72 | 85.38 | 86.04 |
| 65 | 85.42 | 86.05 | 86.68 | 87.31 | 87.94 | 88.57 | 89.20 | 89.83 | 90.47 | 91.10 |
| 70 | 90.49 | 91.10 | 91.71 | 92.31 | 92.92 | 93.53 | 94.14 | 94.74 | 95.35 | 95.95 |
| 75 | 95.39 | 95.98 | 96.57 | 97.15 | 97.73 | 98.32 | 98.90 | 99.47 | 100.05 | 100.62 |

However, Tables 5 and 6 merely provide example values, and many other values are also within the scope of the present disclosure.

Moreover, although FIGS. 9, 11, and 13 depict example radial slot configurations comprising three to five radial slots cut in the casing 122, the cement sheath 124, and the formation 130, it should be understood that other radial slot configurations (not shown), such as may comprise two, six, or more radial slots are also within the scope of the present disclosure.

Figure 15:
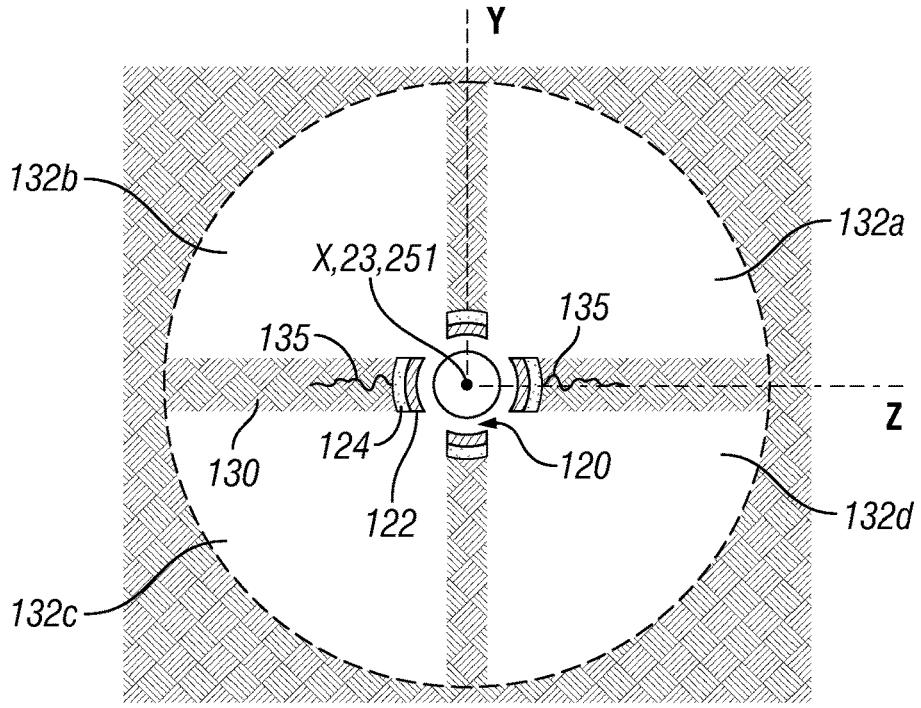
FIG. 15 is a sectional view of a portion of an example implementation of the apparatus shown in FIG. 1 according to one or more aspects of the present disclosure.
Figure 16:
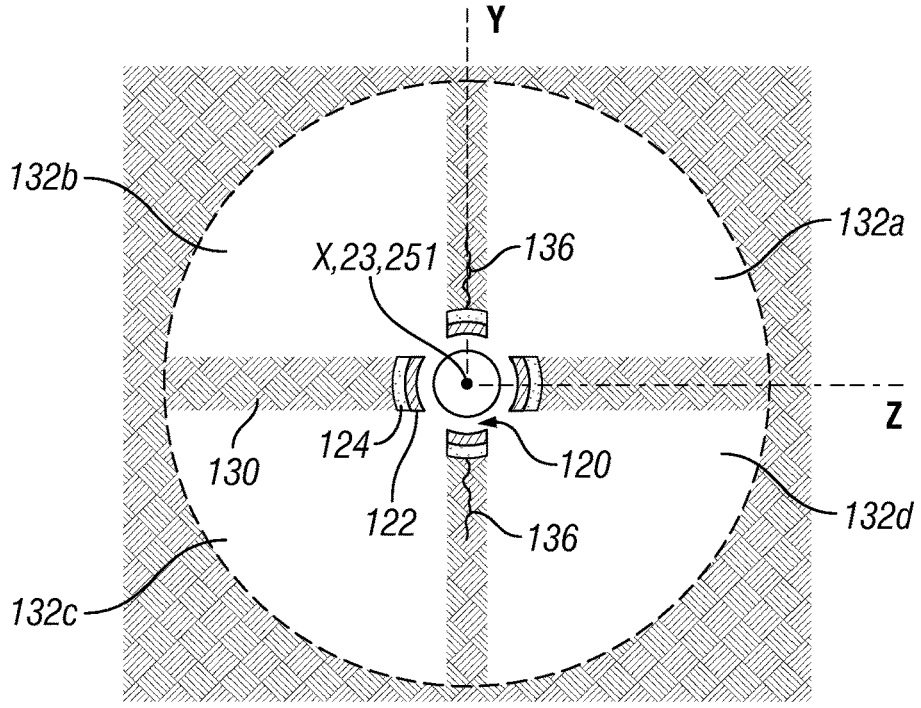
FIG. 16 is a sectional view of a portion of an example implementation of the apparatus shown in FIG. 1 according to one or more aspects of the present disclosure.

FIGS. 15 and 16 are sectional views of another example implementation utilizing the laser cutting system 100 shown in FIGS. 1, 2A, and 2B according to one or more aspects of the present disclosure, depicting an example radial slot configuration cut in the casing 122, the cement sheath 124, and the formation 130, which may be similar to the radial cut configurations depicted in FIG. 9. For example, FIG. 15 depicts radial slots 132*a-d* cut to avoid horizontal directions at or proximate horizontal radial cracks and/or other weaknesses 135 that are suspected or known to have been induced in the formation 130 during the drilling of the wellbore 120 under strike-slip stress conditions. FIG. 16 depicts radial slots 132*a-d* cut to avoid vertical directions at or proximate vertical radial cracks and/or other weaknesses 136 that are suspected or known to have been induced in the formation 130 during the drilling of the wellbore 120 under normal stress conditions. Cutting or perforating into such weaknesses may initiate and/or propagate fracturing along these weaknesses 135, 136 and, therefore, along planes that are longitudinal to the wellbore 120 and coincident with the wellbore axis 23, such as the X-Y plane described above. The radial slot configurations depicted in FIGS. 15 and 16 may avoid these weak zones and favor the initiation of hydraulic fractures that are transverse to the wellbore axis 23, such as along the Y-Z plane. To cut the radial slots 132*a-d* such that the non-cut portions of the formation 130 are precisely oriented in a vertical direction (i.e., the direction of the gravity vector) along the weaknesses 136, as shown in FIG. 16, and in a horizontal direction (i.e., the direction perpendicular to the gravity vector) along the weaknesses 135, as shown in FIG. 15, the angular orientation of the laser cutting apparatus 200 with respect to the direction of gravity may be measured downhole with an inclination sensor and/or other gravity measurement sensor, such as described above, and accounted for by the electronic control system to orient the radial slot pattern.

Furthermore, if horizontal weaknesses 135 are suspected or known to exist, a radial slot configuration comprising two radial slots (not shown) may be formed, wherein each radial slot may extend circumferentially through most of the formation 130 within a given Y-Z plane, but avoid the horizontal weaknesses 135. Similarly, if vertical weaknesses 136 are suspected or known to exist, a radial slot configuration comprising two radial slots (not shown) may be formed, wherein each radial slot may extend circumferentially through most of the formation 130 within a given Y-Z plane, but avoid the vertical weaknesses 136.

Figure 17:
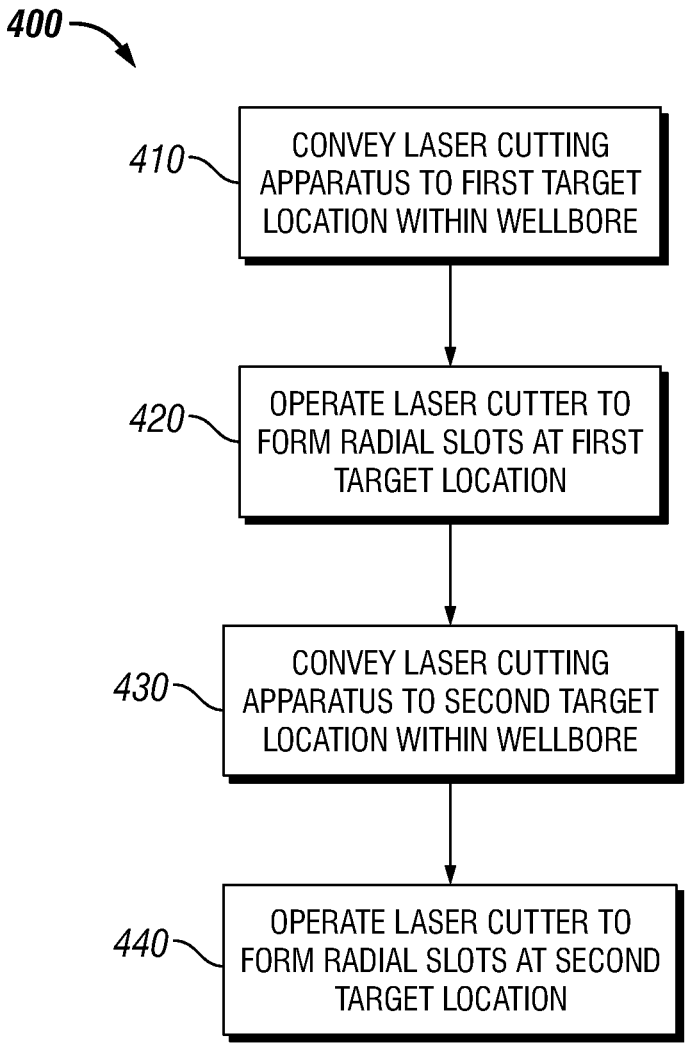
FIG. 17 is a flow-chart diagram of at least a portion of a method according to one or more aspects of the present disclosure.

FIG. 17 is a flow-chart diagram of at least a portion of an example implementation of a method (400) according to one or more aspects of the present disclosure. The method (400) may utilize a laser cutting system, such as at least a portion of the laser cutting system 100 shown in FIG. 1, the tool string 110 shown in FIGS. 1, 2A, and 2B, and/or the laser cutting apparatus 200 shown in FIGS. 2A and 2B, among others within the scope of the present disclosure. Thus, the following description collectively refers to FIGS. 1, 2A, 2B, and 17, among others.

The method (400) comprises conveying (410) the tool string 110 to a first target location within a wellbore 120, wherein the tool string 110 includes the laser cutting apparatus 200. Such conveyance (410) may be via coiled tubing and/or other means.

The method (400) further comprises operating (420) the laser cutting apparatus 200 to form a plurality of slots, such as a plurality of casing slots extending through the casing 122, a plurality of cement sheath slots extending through the cement sheath 124, and a plurality of formation slots 132*a-b* extending into the formation 130 penetrated by the wellbore 120. Each of the casing slots, cement sheath slots, and formation slots may correspond to one or more of the radial slots 132 shown in FIG. 1, the radial slots 132*a-d* shown in FIG. 6B, the radial slots 132*a-d* shown in FIG. 9, the radial slots 133*a-c* shown in FIG. 11, the radial slots 134*a-e* shown in FIG. 13, and/or the radial slots 132*a-d* shown in FIGS. 15 and 16. For example, each radial slot may extend substantially within the Y-Z plane substantially perpendicular to the longitudinal axis 23 of the wellbore 120.

As shown in FIG. 13, among others, the plurality of casing slots may each circumferentially extend through a corresponding first angle 13, while the plurality of formation slots may each circumferentially extend through a corresponding second angle 11 that is substantially greater than each corresponding first angle 13. Thus, the sum of the plurality of second angles 11 through which the formation slots may extend may be substantially greater than the sum of the plurality of first angles 13 through which the casing slots may extend. Each formation slot may extend (at least) a radial distance 21 from the longitudinal axis 23 of the wellbore 120. The sum of the plurality of first angles 13 may be substantially less than 360 degrees, yet the sum of the plurality of second angles 11 may be equal to or greater than 360 degrees.

The method (400) may also comprise conveying (430) the laser cutting apparatus 200 to a second target location within the wellbore and operating (440) the laser cutting apparatus 200 to form additional casing slots, cement sheath slots, and formation slots at the second target location, substantially similar to as described above with respect to the first target location. Other implementations of the method (400) may comprise operating the laser cutting apparatus 200 to form additional casing slots, cement sheath slots, and formation slots at one or more additional target locations. Implementations of the method (400) also within the scope of the present disclosure may be utilized in uncased ("open-hole") wellbores and/or other wellbores in which the radial slots may extend into the formation without first penetrating a casing and/or cement sheath lining the wellbore.

Operating (420, 440) the laser cutting apparatus 200 to form the radial slots at each target location may include communicating a fluid from the wellsite surface 105 to the tool string 110 through the coiled tubing. The fluid may be communicated into an annular space between the laser cutting apparatus 200 and the wellbore 120 to remove particles of the formation from within each of the radial slots.

In view of the entirety of the present disclosure, including the figures and the claims, a person having ordinary skill in the art will readily recognize that the present disclosure introduces an apparatus comprising: a laser cutting apparatus operable in a wellbore to form radial slots in a subterranean formation penetrated by the wellbore and a casing lining at least a portion of the wellbore, wherein the laser cutting apparatus comprises: a housing; a deflector system disposed for rotation about a first axis and rotatable about a second axis at a distance from the first axis; and an optical member conducting a laser beam incident upon the deflector system.

The first and second axes may be substantially parallel.

The housing may comprise a central axis, the first axis and the central axis may substantially coincide, and the second axis may extend between the central axis and a wall of the housing.

The apparatus may further comprise at least two motors operable to rotate the deflector system about the first and second axes.

The deflector system may comprise a first deflector and a second deflector, the first deflector may direct the laser beam toward the second deflector, the second deflector may direct the laser beam to be incident upon the formation, the first deflector may rotate about the first axis, and the second deflector may rotate about the second axis. The laser cutting apparatus may further comprise: a first motor operable to rotate the first deflector and the second deflector about the first axis; and a second motor operable to rotate the second deflector about the second axis. The second deflector may change the direction of the laser beam at least two times. The deflector system may further comprise a third deflector, the second deflector may direct the laser beam toward the third deflector, and the third deflector may direct the laser beam to be incident upon the formation. The laser cutting apparatus may further comprise a controller disposed within the housing, wherein the controller may be operable to control the laser cutting apparatus to form the radial slots having a predetermined configuration, angle, depth, and/or spacing.

The laser cutting apparatus may be operable to connect with a coiled tubing string.

The housing may comprise a first housing section and a second housing section, the first housing section may be rotationally coupled with the second housing section, and the first housing section may rotate about the first axis.

The housing may comprise a first housing section and a second housing section, the first housing section may be coupled with the second housing section, the deflector system may comprise a first deflector and a second deflector, the second deflector may optically interpose the optical member and the first deflector, and the first deflector may be disposed within the first housing section.

The deflector system may comprise at least one prism.

The deflector system may comprise at least one mirror.

The housing may comprise at least one port operable to communicate a fluid from the housing into the wellbore.

The housing may comprise a cover portion disposed about the deflector system. At least a portion of the cover portion may be cut off by the laser beam.

The optical member may be in optical communication with a laser source located at a wellsite surface from which the wellbore extends.

The apparatus may further comprise a casing collar locator operable to log the position of the laser cutting apparatus within the wellbore.

The apparatus may further comprise a setting apparatus operable to positionally fix the laser cutting apparatus such that the first axis and a central axis of the wellbore may substantially coincide during laser cutting operations.

The housing may comprise a window extending therethrough. The window may be transparent to the laser beam directed by the deflector system to be incident upon the formation. The window may extend circumferentially about the housing.

The present disclosure also introduces a system comprising: a laser cutting system operable in a wellbore to remove material from a subterranean formation penetrated by the wellbore and a casing lining the wellbore, wherein the laser cutting system comprises: a laser source located at a wellsite surface from which the wellbore extends; an optical conductor in optical communication with the laser source; and a tool string comprising a laser cutting apparatus, wherein the laser cutting apparatus comprises a deflection system operable to direct a laser beam received from the laser source via the optical conductor to be incident upon the casing and the formation, wherein at least a portion of the deflection system is operable to rotate about first and second radially offset axes.

The first and second axes may be substantially parallel with respect to each other.

The system may further comprise coiled tubing extending between the tool string and equipment at the wellsite surface. The optical conductor may be disposed within the coiled tubing. The coiled tubing may be operable to communicate fluid from the wellsite surface to the tool string, and the tool string may comprise at least one fluid port operable to communicate a fluid from interior of the tool string into the wellbore.

The deflection system may comprise a first deflector and a second deflector, the first deflector may optically interpose the optical conductor and the second deflector to direct the laser beam to the second deflector, and the second deflector may be operable to rotate about the first and second axes. The laser cutting apparatus may further comprise: a first motor operable to rotate the first deflector; and a second motor operable to rotate the second deflector. The laser cutting apparatus may further comprise: a housing; a controller disposed within the housing; and an electrical conductor extending between the wellsite surface and the controller, wherein the controller may be operable to process signals received from the wellsite surface to control rotational position of the first and second motors.

The housing may comprise a first housing section and a second housing section, the first housing section may be rotationally coupled with the second housing section, and the first housing section may be operable to rotate about the first axis.

The tool string may further comprise a casing collar locator operable to detect the position of the tool string within the wellbore.

The tool string may further comprise a setting apparatus operable to positionally fix the laser cutting apparatus relative to the wellbore during operations. The setting apparatus may be operable to positionally fix the first axis of the laser cutting apparatus along the central axis of the wellbore.

The laser cutting apparatus may comprise a cover disposed about the deflection system.

The present disclosure also introduces a method comprising: conveying a tool string to a target location within a wellbore, wherein the tool string includes a laser cutting apparatus; and operating the laser cutting apparatus to form a plurality of casing slots extending through a casing lining the wellbore, and a plurality of formation slots extending into a subterranean formation penetrated by the wellbore, wherein: each of the plurality of casing slots and each of the plurality of formation slots extend substantially within a plane that is substantially perpendicular to a longitudinal axis of the wellbore; the plurality of casing slots each circumferentially extend through a corresponding one of a plurality of first angles about the longitudinal axis of the wellbore; the plurality of formation slots each circumferentially extend through a corresponding one of a plurality of second angles about the longitudinal axis of the wellbore; and each of the plurality of second angles is greater than each of the plurality of first angles.

The sum of the plurality of second angles may be substantially greater than the sum of the plurality of first angles.

The sum of the plurality of first angles may be less than 360 degrees, and the sum of the plurality of second angles at the radial distance may be equal to or greater than 360 degrees.

Conveying the tool string within the wellbore may be via coiled tubing.

The target location may be a first target location, and the method may further comprise: positioning the laser cutting apparatus at a second target location within the wellbore, and operating the laser cutting apparatus to form, at the second target location, a second plurality of casing slots extending through the casing lining the wellbore, and a second plurality of formation slots extending into the formation penetrated by the wellbore, wherein: each of the second plurality of casing slots and each of the second plurality of formation slots may extend substantially within a second plane that is substantially perpendicular to the longitudinal axis of the wellbore; the second plurality of casing slots may each circumferentially extend through a corresponding one of a second plurality of first angles about the longitudinal axis of the wellbore; the second plurality of formation slots may each circumferentially extend through a corresponding one of a second plurality of second angles about the longitudinal axis of the wellbore; and each of the second plurality of second angles may be greater than each of the second plurality of first angles. Positioning the laser cutting apparatus at the second target location within the wellbore may comprise moving the laser cutting apparatus in the uphole direction to position the laser cutting apparatus at the second target location within the wellbore.

Conveying the tool string to the target location within the wellbore may comprise conveying the tool string via coiled tubing, and the method may further comprise: communicating a fluid from a wellsite surface from which the wellbore extends to the tool string through the coiled tubing; and communicating the fluid into an annular space between the laser cutting apparatus and the wellbore to remove particles of the formation from within each of the plurality of casing and formation slots.

Operating the laser cutting apparatus may further comprise cutting off at least a portion of a cover of the laser cutting apparatus. The method may exclude moving the laser cutting apparatus in a downhole direction after cutting off at least the portion of the cover.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus, comprising:

a laser cutting apparatus operable in a wellbore to form radial slots in a subterranean formation penetrated by the wellbore and a casing lining at least a portion of the wellbore, wherein the laser cutting apparatus comprises:

a housing;

a deflector system having a first deflector disposed for rotation about a first axis and having a second deflector rotatable about a second axis at a radial distance from the first axis, wherein the first and second axes are substantially parallel with respect to each other; and an optical member conducting a laser beam incident upon the deflector system.

2. The apparatus of claim 1 wherein the first deflector directs the laser beam toward the second deflector, wherein the second deflector directs the laser beam to be incident upon the formation, wherein the first deflector rotates about the first axis, and wherein the second deflector rotates about the second axis.

3. The apparatus of claim 2 wherein the laser cutting apparatus further comprises:

a first motor operable to rotate the first deflector and the second deflector about the first axis; and a second motor operable to rotate the second deflector about the second axis.

4. The apparatus of claim 2 wherein the second deflector changes the direction of the laser beam at least two times.

5. The apparatus of claim 2 wherein the deflector system further comprises a third deflector, wherein the second deflector directs the laser beam toward the third deflector, and wherein the third deflector directs the laser beam to be incident upon the formation.

6. The apparatus of claim 1 wherein the optical member is in optical communication with a laser source located at a wellsite surface from which the wellbore extends.

7. A system, comprising:

a laser cutting system operable in a wellbore to remove material from a subterranean formation penetrated by the wellbore and a casing lining the wellbore, wherein the laser cutting system comprises:

a laser source located at a wellsite surface from which the wellbore extends;

an optical conductor in optical communication with the laser source; and a tool string comprising a laser cutting apparatus, wherein the laser cutting apparatus comprises a deflection system operable to direct a laser beam received from the laser source via the optical conductor to be incident upon the casing and the formation, wherein at least a first portion of the deflection system is operable to rotate about a first axis and a second portion of the deflection system operable to rotate about a second axis, the first and second axes substantially parallel to and radially offset from one another.

8. The system of claim 7 further comprising coiled tubing extending between the tool string and equipment at the wellsite surface, wherein the optical conductor is disposed within the coiled tubing, wherein the coiled tubing is operable to communicate fluid from the wellsite surface to the tool string, and wherein the tool string comprises at least one fluid port operable to communicate a fluid from interior of the tool string into the wellbore.

9. The system of claim 7 wherein the deflection system comprises a first deflector and a second deflector, wherein the first deflector optically interposes the optical conductor and the second deflector to direct the laser beam to the second deflector, and wherein the second deflector is operable to rotate about the first and second axes.

10. The system of claim 7 wherein the tool string further comprises a casing collar locator operable to detect the position of the tool string within the wellbore.

11. The system of claim 7 wherein the tool string further comprises a setting apparatus operable to positionally fix the laser cutting apparatus relative to the wellbore during operations.

12. A method, comprising:

conveying a tool string to a target location within a wellbore, wherein the tool string includes a laser cutting apparatus; and operating the laser cutting apparatus to form a plurality of casing slots extending through a casing lining the wellbore, and a plurality of formation slots extending into a subterranean formation penetrated by the wellbore, wherein:

each of the plurality of casing slots and each of the plurality of formation slots extend within a plane that is perpendicular to a longitudinal axis of the wellbore;

the plurality of casing slots each circumferentially extend through a corresponding one of a plurality of first angles about the longitudinal axis of the wellbore;

the plurality of formation slots each circumferentially extend through a corresponding one of a plurality of second angles about the longitudinal axis of the wellbore; and each of the plurality of second angles is greater than each of the plurality of first angles.

13. The method of claim 12 wherein the sum of the plurality of first angles is less than 360 degrees, and wherein the sum of the plurality of second angles at the radial distance is equal to or greater than 360 degrees.

14. The method of claim 12 wherein conveying the tool string within the wellbore is via coiled tubing.

15. The method of claim 12 wherein the target location is a first target location and the method further comprises:

positioning the laser cutting apparatus at a second target location within the wellbore, and operating the laser cutting apparatus to form, at the second target location, a second plurality of casing slots extending through the casing lining the wellbore, and a second plurality of formation slots extending into the formation penetrated by the wellbore, wherein:

each of the second plurality of casing slots and each of the second plurality of formation slots extend within a second plane that is perpendicular to the longitudinal axis of the wellbore;

the second plurality of casing slots each circumferentially extend through a corresponding one of a second plurality of first angles about the longitudinal axis of the wellbore;

the second plurality of formation slots each circumferentially extend through a corresponding one of a second plurality of second angles about the longitudinal axis of the wellbore; and each of the second plurality of second angles is greater than each of the second plurality of first angles.

16. The method of claim 12 wherein conveying the tool string to the target location within the wellbore comprises conveying the tool string via coiled tubing, and wherein the method further comprises:

communicating a fluid from a wellsite surface from which the wellbore extends to the tool string through the coiled tubing; and communicating the fluid into an annular space between the laser cutting apparatus and the wellbore to remove particles of the formation from within each of the plurality of casing and formation slots.

17. The method of claim 12 wherein operating the laser cutting apparatus further comprises cutting off at least a portion of a cover of the laser cutting apparatus.

18. The method of claim 17 wherein the method excludes moving the laser cutting apparatus in a downhole direction after cutting off at least the portion of the cover.

* * * * *